US008881470B1

(12) United States Patent
Lass

(10) Patent No.: US 8,881,470 B1
(45) Date of Patent: Nov. 11, 2014

(54) COLLAPSIBLE STRUCTURE

(71) Applicant: Gary D. Lass, Ames, IA (US)

(72) Inventor: Gary D. Lass, Ames, IA (US)

( * ) Notice: Subject to any disclaimer, the term of this patent is extended or adjusted under 35 U.S.C. 154(b) by 0 days.

(21) Appl. No.: 14/144,886

(22) Filed: Dec. 31, 2013

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04B 1/343*** | (2006.01) |
| ***E04H 1/12*** | (2006.01) |

(52) U.S. Cl.
CPC ..... *E04B 1/34336* (2013.01); *E04H 1/12* (2013.01)
USPC ..... 52/79.5; 52/79.1; 52/64; 52/69; 52/70; 52/71

(58) Field of Classification Search
CPC ..... E04B 1/343; E04B 1/34357; E04B 1/344; E04B 1/3442; E04B 1/3445; E04B 1/3448; E04B 1/34321
USPC ..... 52/79.1, 79.5, 64, 69, 70, 71
See application file for complete search history.

(56) References Cited

U.S. PATENT DOCUMENTS

| | | | | |
|---|---|---|---|---|
| 2,883,713 | A * | 4/1959 | Zug | 52/71 |
| 4,672,779 | A * | 6/1987 | Boyd | 52/79.4 |
| 5,611,449 | A * | 3/1997 | Pedersen | 220/6 |
| 8,613,166 | B2 * | 12/2013 | Smith | 52/66 |
| 2005/0044804 | A1 * | 3/2005 | Bin et al. | 52/79.5 |
| 2010/0287847 | A1 * | 11/2010 | Smith | 52/79.5 |
| 2010/0293868 | A1 * | 11/2010 | Holzworth | 52/79.5 |
| 2012/0180404 | A1 * | 7/2012 | Scouten | 52/79.5 |

* cited by examiner

*Primary Examiner* — Mark Wendell
(74) *Attorney, Agent, or Firm* — G. Brian Pingel; Camille L. Urban; David M. Breiner

(57) ABSTRACT

Example embodiments relate to a collapsible structure. In example embodiments elements of the structure may be connected together in a manner that allows the structure to collapse from a relatively open structure into a relatively compact structure. The structure may have many uses which may include, but are not limited to, a hunting shack, a storage shack, a boat house, an emergency shelter, and a hut.

20 Claims, 30 Drawing Sheets

COLLAPSIBLE STRUCTURE

BACKGROUND

1. Field

Example embodiments relate to a collapsible structure. In example embodiments the structure may be configured to collapse from a relatively large structure to a relatively compact structure. The structure may have many uses which may include, but are not limited to, a hunting shack, a storage shack, an ice fishing house, an emergency shelter, and a hut.

2. Description of the Related Art

Temporary and collapsible structures are used in a variety of applications. Tents, for example, provide a quick and relatively easy means to provide temporary housing for hunters and/or campers. Some ice fishing huts, as another example, resemble a tent and provide a temporary housing for ice fishermen. These structures, however, often do not provide adequate protection against high winds and heavy rains. As a consequence, some artisans have turned to designing collapsible structures having rigid panels pivotally connected to one another so the structure may be collapsed. These structures work relatively well for their intended purposes, however, they all suffer from one or more disadvantages in terms of portability and ease of assembly.

SUMMARY

Example embodiments relate to a collapsible structure. In example embodiments the structure may be configured to collapse from a relatively large structure to a relatively compact structure. The structure may have many uses which may include, but are not limited to, a hunting shack, a storage shack, an ice fishing house, an emergency shelter, and a hut.

In accordance with example embodiments, a structure may be configured to collapse from a first configuration to a second configuration. In example embodiments the structure may include a base having a first subwall, a second subwall, and a third subwall. In example embodiments the first subwall may have a first depth, the second subwall may have a second depth, and the third subwall may have a third depth. In example embodiments, the structure may further include a first wall pivotally connected to the first subwall, a second wall pivotally connected to the second subwall, a third wall pivotally connected to the third subwall, and a fourth wall pivotally connected to the base. In example embodiments, the first depth may be greater than the second depth and the second depth may be greater than the third depth.

In accordance with example embodiments, a structure may be configured to collapse from a first configuration to a second configuration. In example embodiments, the structure may include a base, a first wall pivotally connected to the base, a second wall pivotally connected to the base, a third wall pivotally connected to the base and a fourth wall pivotally connected to the base. In example embodiments the first wall may include a first wall panel and a first roof section and the second wall may include a second wall panel and a second roof section. In example embodiments, the structure may further include a first latch having a first keeper on one of the first and second roof sections and a first catch on the other of the first and second roof sections, the first catch being configured to engage the first keeper. In example embodiments, the structure may further include a first plurality of latches connecting the first wall to the fourth wall, a second plurality of latches connecting the first wall to the third wall, a third plurality of latches connecting the fourth wall to the second wall, and a fourth plurality of latches connecting the second wall to the third wall.

BRIEF DESCRIPTION OF THE DRAWINGS

Example embodiments are described in detail below with reference to the attached drawing figures, wherein.

DETAILED DESCRIPTION

Figure 1A:
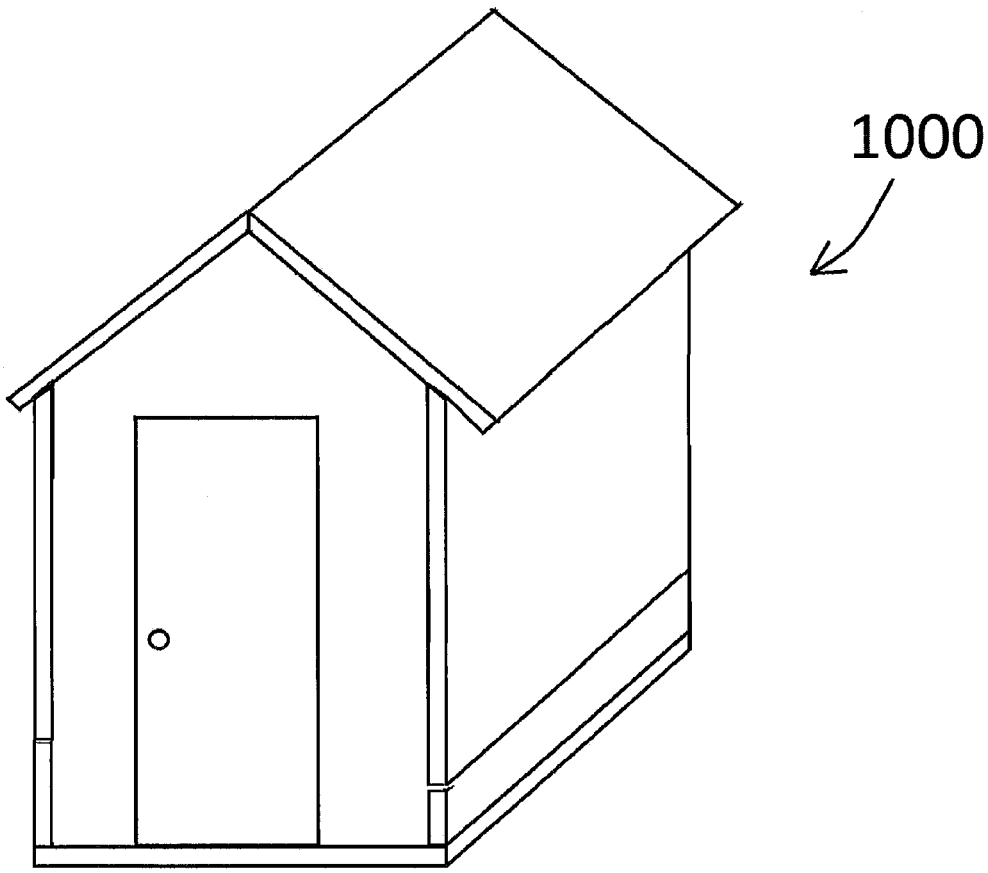
FIG. 1A is a perspective view of a structure in accordance with examples embodiments.

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "attached to," "connected to," or "coupled to" another element or layer, it can be directly on, directly attached to, directly connected to, or directly coupled to the other element or layer or intervening elements that may be present. In contrast, when an element is referred to as being "directly on," "directly attached to," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to planform views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a collapsible structure. In example embodiments various elements of the structure may be hinged together in a manner that allows the structure to collapse into a relatively compact structure. The structure may have many uses which may include, but are not limited to, a hunting shack, a storage shack, a boat house, an emergency shelter, and a hut.

Figure 1B:
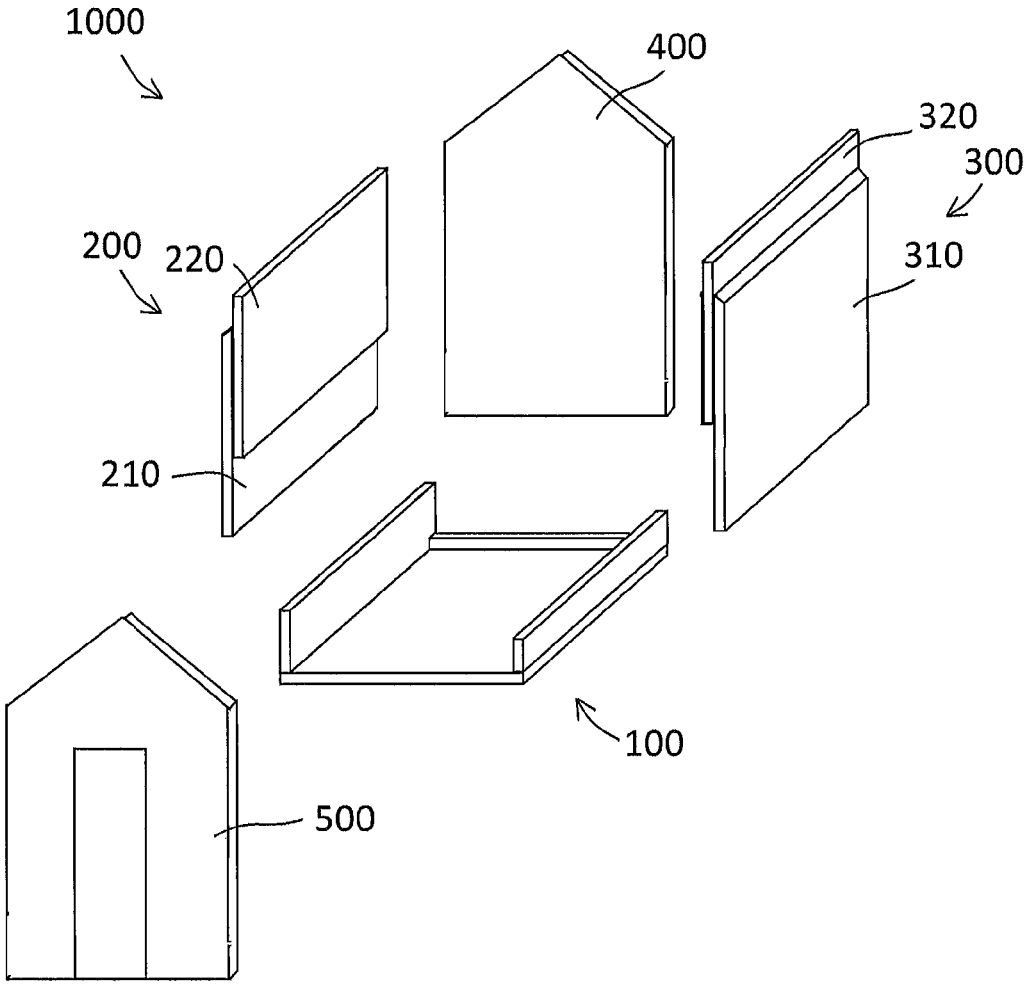
FIG. 1B is an exploded view of the structure in accordance with example embodiments.

FIG. 1A is a view of a structure 1000 in accordance with example embodiments and FIG. 1B is an exploded view of the structure 1000 in accordance with example embodiments. As shown in FIGS. 1A and 1B, the structure 1000 may include a base 100, a first wall 200, a second wall 300, a third wall 400, and a fourth wall 500. As will be explained shortly, the first wall 200 may include a first roof section 220 and the second wall 300 may include a second roof section 320 which may be used to form a roof a the structure 1000. In example embodiments, the structure 1000 may be suitable for various purpose's. For example, the structure 1000 may be used as a hunting shack, a storage shack, a boat house, an emergency shelter, and a hut. This list, however, is provided for purposes of illustration only as the structure 1000 may be used for a variety of other purposes.

Figure 2A:
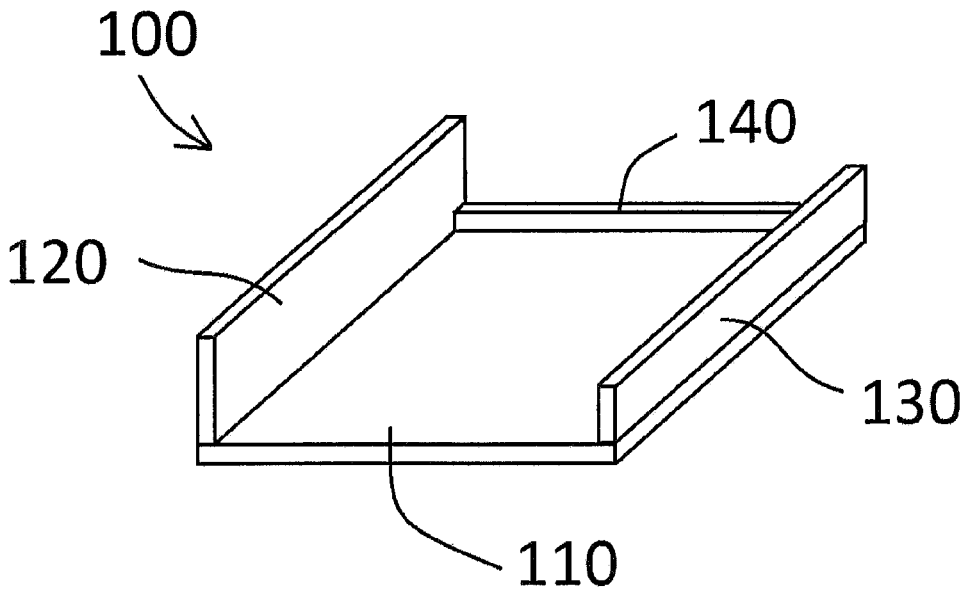
FIG. 2A is a view of a base in accordance with example embodiments.
Figure 2B:
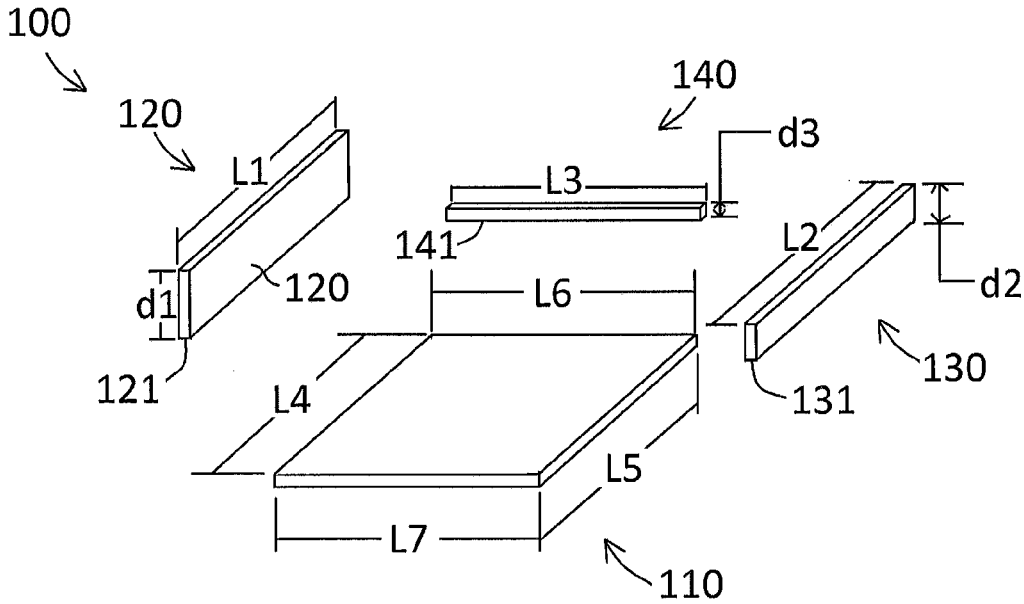
FIG. 2B is an exploded view of the base in accordance with example embodiments.

FIG. 2A is a view of the base 100 in accordance with example embodiments and FIG. 2B is an exploded view of the base 100 in accordance with example embodiments. As shown in FIGS. 2A and 2B, the base 100 may include a floor 110 and three subwalls 120, 130, and 140 protruding from the floor 110. In example embodiments, the floor 110 may be substantially flat and may either present a solid floor (as shown in the figures) or may have an aperture in the floor which may allow the structure 1000 to be used as an ice hut. Further yet, the floor 110 may include a plurality of apertures if ventilation through the floor is desired. In other words, the floor 110 may be modified depending on the intended purposes and such modifications are considered to fall within example embodiments.

In example embodiments, the first subwall 120 may resemble a substantially rectangular member having a first length L1 and a first depth d1. In example embodiments, a bottom surface 121 of the first subwall 120 may bear against the floor 110. In example embodiments, the bottom surface 121 may directly contact the floor 110 or may be attached to an intermediate member that may contact the floor 110. In example embodiments, the first subwall 120 may be attached to the floor 110 by a conventional method which may include, but is not limited to, pins, bolts, welds, screws, and nails.

In example embodiments, the second subwall 130 may resemble a substantially rectangular member having a second length L2 and a second depth d2. In example embodiments, a bottom surface 131 of the second subwall 130 may bear against the floor 110. In example embodiments, the bottom surface 131 may directly contact the floor 110 or may be attached to an intermediate member that may contact the floor 110. In example embodiments, the second subwall 130 may be attached to the floor 110 by a conventional method which may include, but is not limited to, pins, bolts, welds, screws, and nails. In example embodiments the second depth d2 may be smaller than the first depth d1 of the first subwall 120.

In example embodiments, the third subwall 140 may resemble a substantially rectangular member having a third length L3 and a third depth d3. In example embodiments, a bottom surface 141 of the third subwall 140 may bear against the floor 110. In example embodiments, the bottom surface 141 may directly contact the floor 110 or may be attached to an intermediate member that may contact the floor 110. In example embodiments, the third subwall 140 may be attached to the floor 110 by a conventional method which may include, but is not limited to, pins, bolts, welds, screws, and nails. In example embodiments the third depth d3 may be smaller than the second depth d2 of the second subwall 130.

In example embodiments, the floor 110 may resemble a rectangular floor having a first edge having a length of L4, a second edge having a length of L5, a third edge having a length of L6, and a fourth edge having a length of L7. In example embodiments, the floor may have a square profile in which case the lengths LA, L5, L6, and L7 may be substantially the same. On the other hand, the lengths L6 and L7 of the third and fourth edges may smaller or larger than the lengths L4 and L5 of the first and second egdes, in which case, the floor may resemble a rectangle rather than a square. In example embodiments, the length L1 of the first subwall may be, but is not required to be, substantially the same as the length L4 of the first edge of the floor 110 and the length L2 of the second subwall 130 may be, but is not required to be, substantially the same as the length L5 of the second edge of the floor 110. Thus, in example embodiments, the first and second subwalls 120 and 130 may span a length of the floor 110. In example embodiments, the length L3 of the third subwall 140 may be about the same as the length L6 of the third edge of the floor 110 or may be shorter than the length L6 of the third edge of the floor 110. For example, the length L3 of the third subwall 140 may be substantially equal to the length L6 of the third edge of the floor 110 minus the thicknesses of the first subwall 120 and the second subwall 130.

In example embodiments, the floor 110, the first subwall 120, the second subwall 130, and the third subwall 140 may be separately formed and then attached together via a conventional method as described above. However, example embodiments are not limited thereto. For example, rather than assembling the base 100 from four separately manufactured pieces (110, 120, 130, and 140), the base 100 may be formed as one structure via a casting process. For example, the base may be made from a plastic, a metal, or a composite material.

Figure 2C:
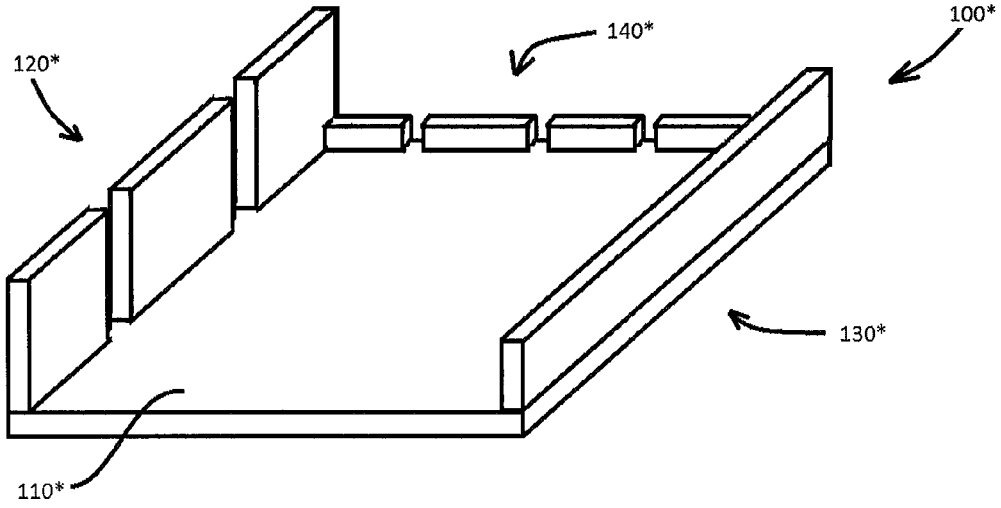
FIG. 2C is a view of another base in accordance with example embodiments.

It is understood that the various features mentioned above are for purposes of illustration and are not meant to limit the invention. For example, in example embodiments, the third subwall 140, rather than having a length L3 which is substantially equal to the length L6 of the third edge of the floor 110 (minus the thickness of the first subwall 120 and the second subwall 130), may have a length shorter than the length L6 of the third edge of the floor 110 (minus the thickness of the first subwall 120 and the second subwall 130). Furthermore, although the figures show each of the first, second, and third subwalls 120, 130, and 140 as being substantially solid rectangular members with constant thicknesses, the invention is not limited thereto. For example, the first, second, and third subwalls 120, 130, and 140 may have an irregular shape and may not have constant thicknesses. As another example, each of the subwalls 120, 130, and 140 may include apertures or may be made of several sections rather than solid sections. For example, FIG. 2C illustrates another example of a base 100* usable with example embodiments. As shown in FIG. 2C, rather than having solid subwalls, the subwalls of the base 100* are made of several sections. For example, the first and third subwalls 120* and 140* of the base 100* may be comprised of several sections whereas the second subwall 130* may be comprised of a continuous section.

Figure 3A:
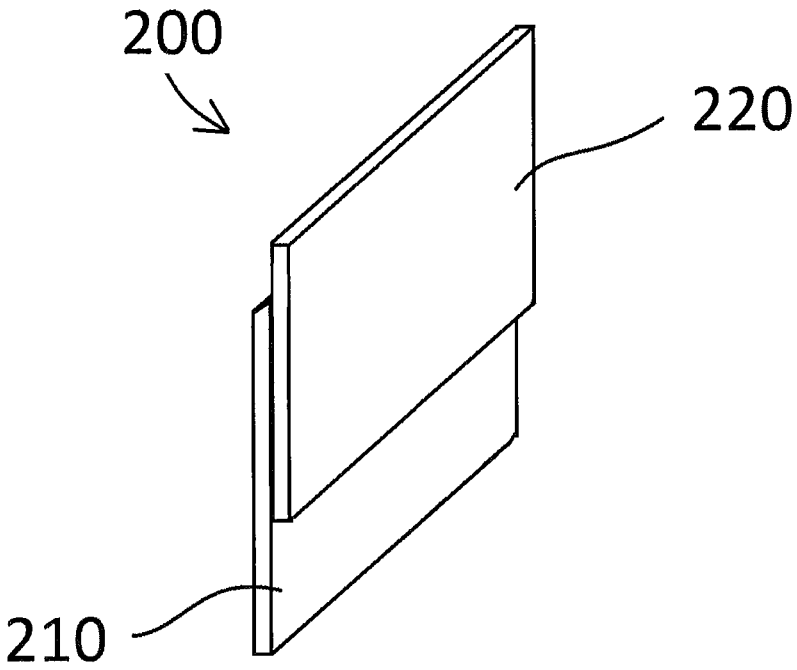
FIGS. 3A-3D are views of a wall in accordance with example embodiments.

FIG. 3A is a view of the first wall 200 in accordance with example embodiments. As shown in FIG. 3A, the first wall 200 may be comprised of a first wall panel 210 and a first roof section 220. In example embodiments, the first wall panel 210 and the first roof section 220 may be pivotally connected to one another. For example, a hinge 230, as shown in FIG. 3C, may be provided between first wall panel 210 and the first roof section 220 to pivotally connect the first wall panel 210 to the first roof section 220. In example embodiments, the hinge 230 may be, but is not required to be, a bi-fold hinge, a butt hinge, a case hinge, an offset hinge, or a continuous hinge. For example, the hinge 230, may, for example, be comprised of a first plate 234 attached to the first wall panel 210 and a second plate 232 attached to the first roof section 220. In example embodiments, the first and second plates 232 and 234 may be connected to one another by a pin so that the first wall panel 210 is pivotally connected to the first roof section 220.

Figure 3B:
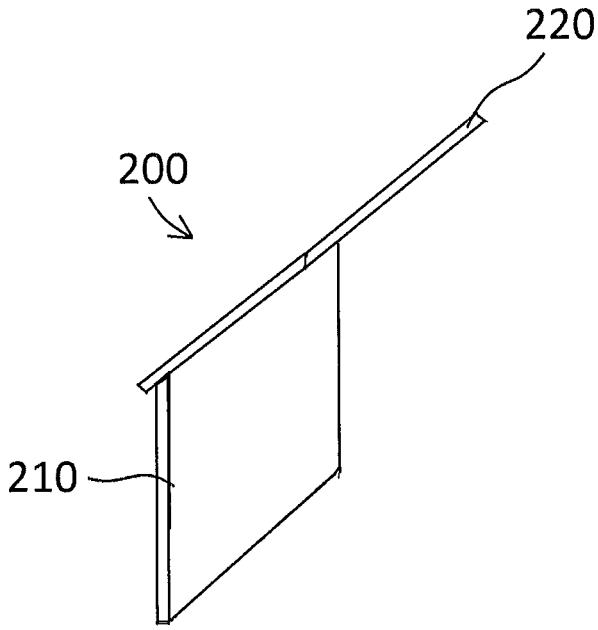
Figure 3C:
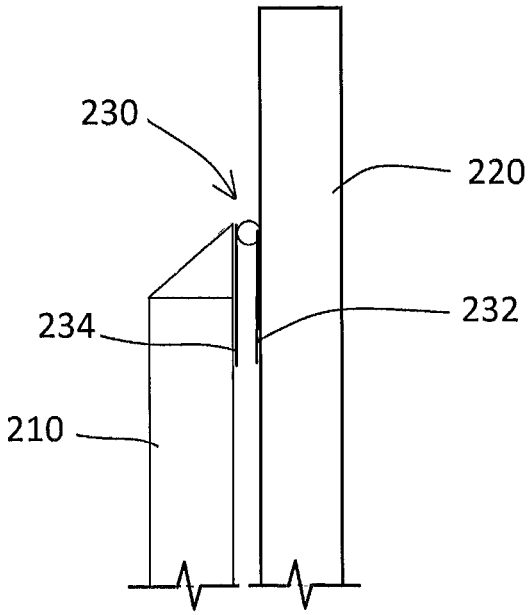
Figure 3D:
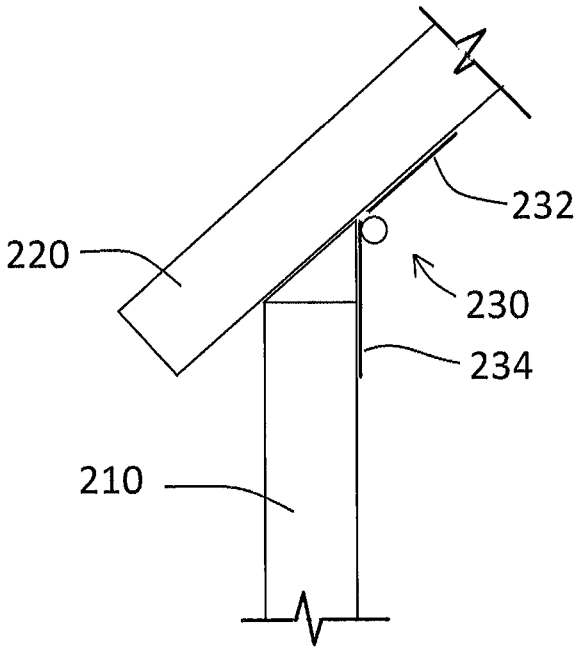

FIG. 3B illustrates the first wall 200 with the first roof section 220 rotated away from the first wall panel 210, FIG. 3D illustrates a closeup view of the hinge 230 connecting the first roof section 220 to the first wall panel 210 when the first roof section 220 is rotated away from the first wall panel 210. In example embodiments, the second wall 300 may resemble the first wall 200 in that it may also include a roof section 320 (hereinafter second roof section) and a wall panel 310 (hereinafter second wall panel). In example embodiments, the second wall 300 may be substantially the same as the first wall 200, thus, a detailed description thereof is omitted for the sake of brevity.

Figure 4A:
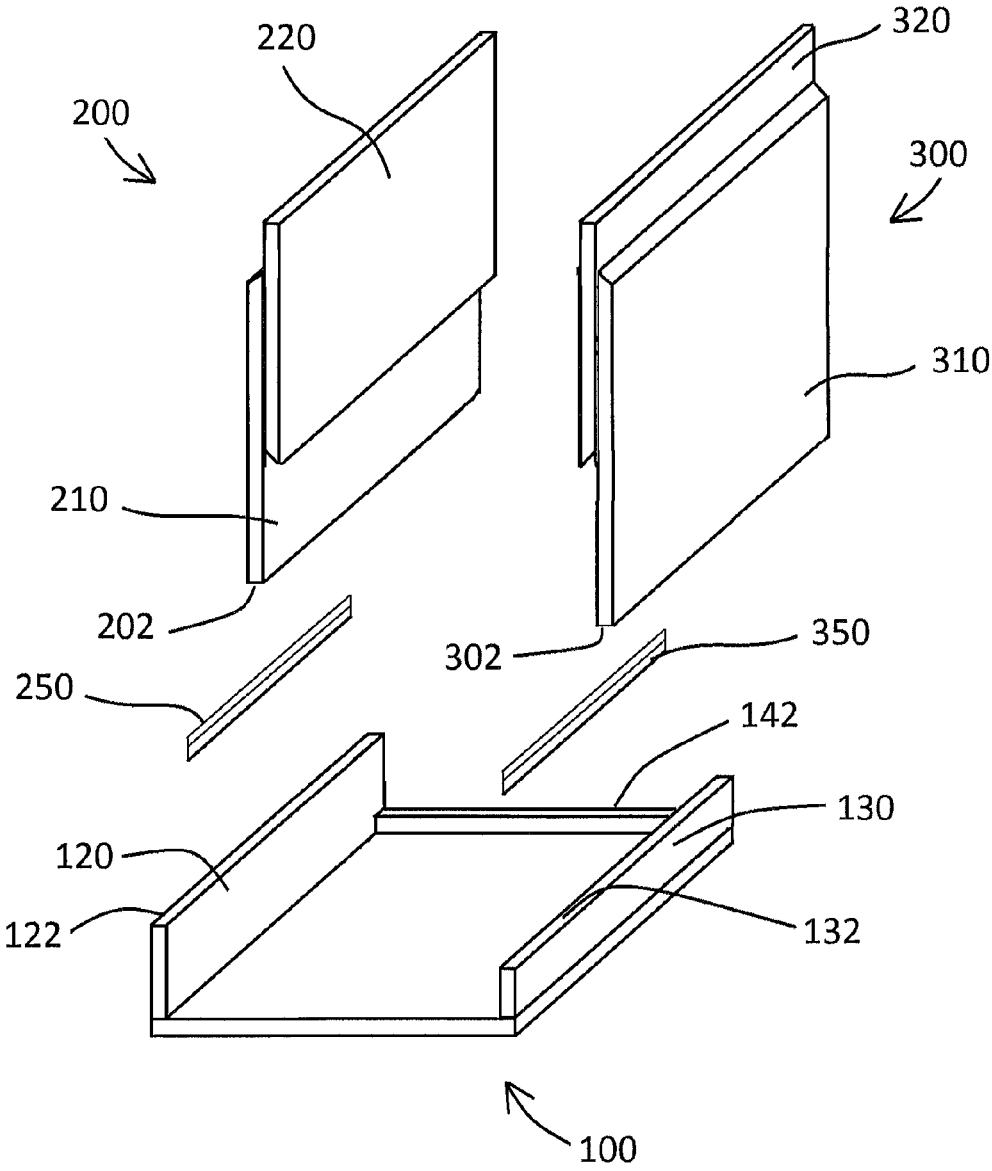
FIGS. 4A-4E are views of walls and the base in accordance with example embodiments and various configurations of the walls and the base.
Figure 4B:
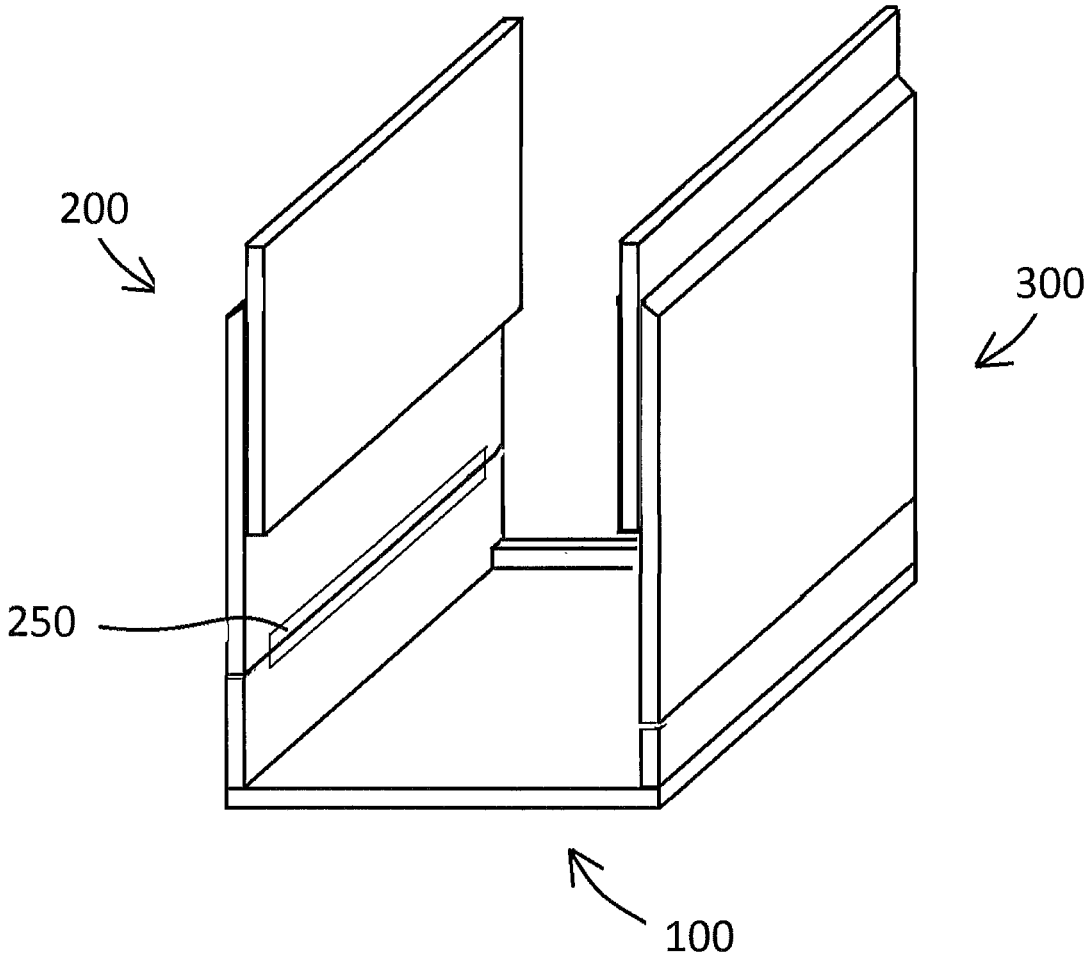

FIG. 4A illustrates an exploded view of the structure 1000 not including the third and fourth walls 400 and 500. FIG. 4B illustrates the first and second walls 200 and 300 attached to the base 100. In example embodiments, the first and second walls 200 and 300 may be pivotally attached to the base 100. For example, as shown in FIGS. 4A and 4B, the first and second walls 200 and 300 may be pivotally attached to the base 100 via a first hinge 250 and a second hinge 350. In example embodiments, the first and second hinges 250 and 350 may be, but are not limited to, bi-fold hinges, butt hinges, case hinges, offset hinges, and continuous hinges. On the other hand, rather than providing a single hinge 250 to connect the first wall 200 to the base 100, a plurality of hinges may be provided. Similarly, rather than providing a single hinge 350 to connect the second wall 300 to the base 100, a plurality of hinges may be provided.

Figure 4C:
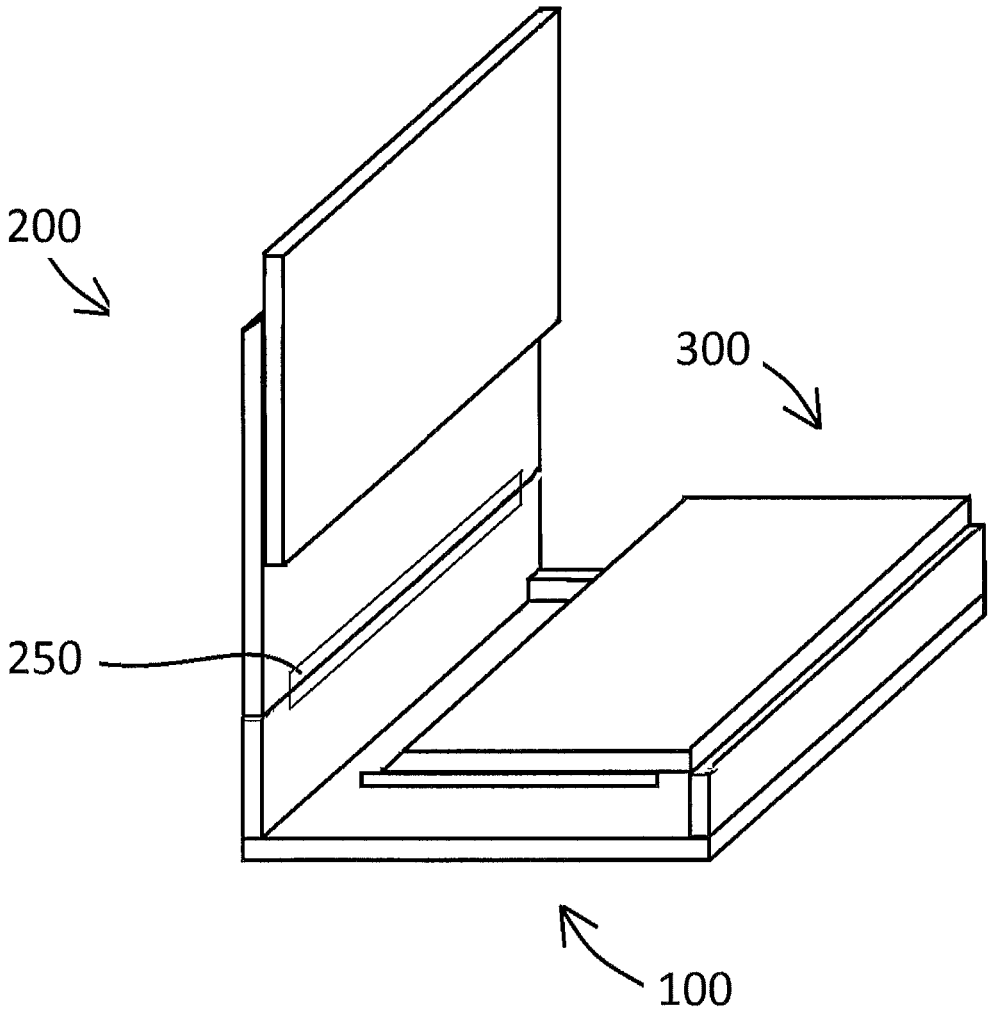
Figure 4D:
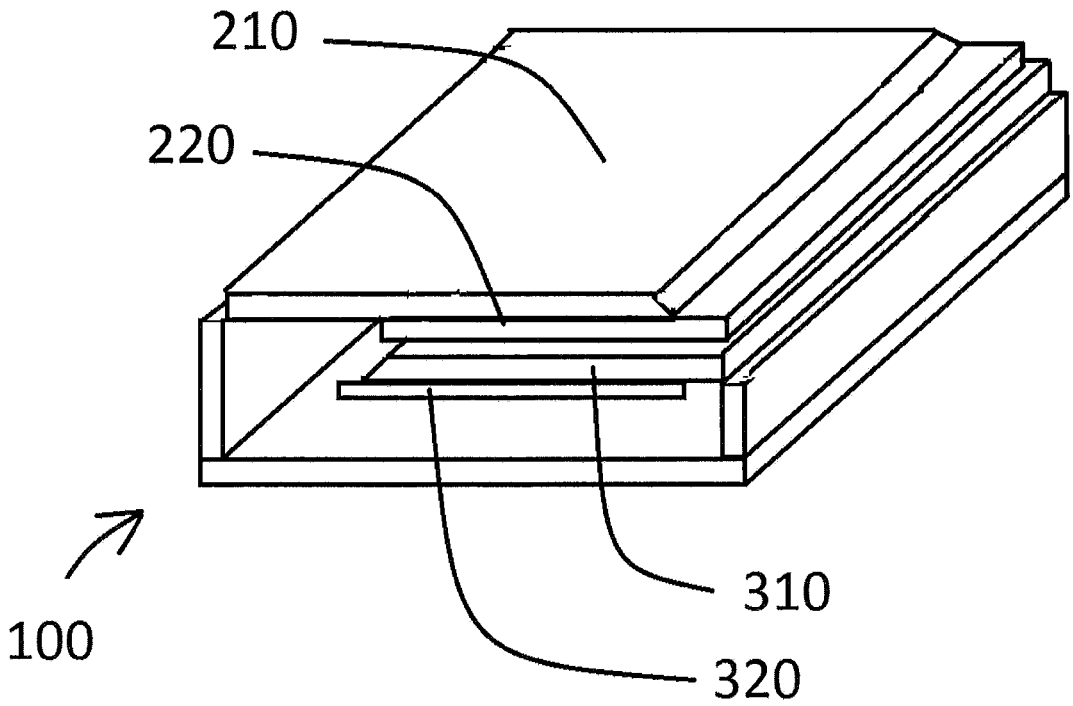
Figure 4E:
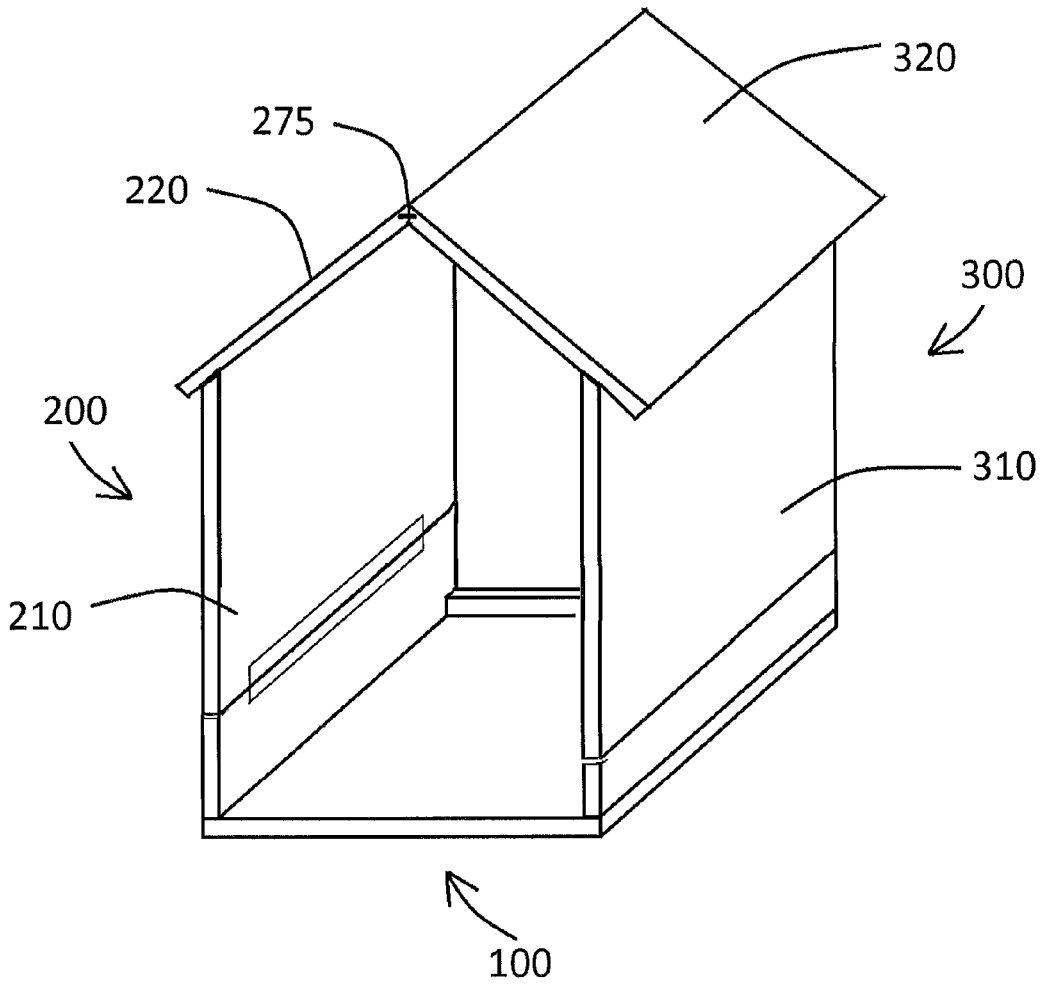

In example embodiments, the first wall 200 may be arranged over the first subwall 120 such that a bottom surface 202 of the first wall 200 faces an upper surface 122 of the first subwall 120. Similarly, the second wall 300 may be arranged over the second subwall 130 such that a bottom surface 302 of the second wall 300 faces an upper surface 132 of the second subwall 130. In this configuration, the first and second hinges 250 and 350 may pivotally connect the first and second walls 200 and 300 to the first and second subwalls 120 and 130 as shown in FIG. 4B. Due to the nature of the pivotal connection, the second wall 300 may be rotated towards a middle of the base 100 as shown in FIG. 4C and the first wall 200 may be rotated on top of the second wall 300 as shown in FIG. 4D. In the alternative, the first and second wall panels 210 and 310 may be maintained in a substantially vertical orientation and the first and second roof sections 220 and 320 may be rotated towards one another to form a roof as shown in. FIG. 4E. In example embodiments, a fastener 275, for example, a latch, may be incorporated in the structure 1000 and the fastener 275 may be used to connect the two roof sections 220 and 320 together.

In example embodiments, the depth d1 of the first subwall 120 may be larger than the depth d2 of the second subwall 130. For example, in example embodiments, the depth d1 of the first subwall 120 may be larger than the depth d2 of the second subwall 130 by an amount approximately equal to a sum of the thicknesses of the first roof section 220, the second roof section 320, and the second wall panel 310. In example embodiments, the difference in depth may also take into account various connectors (3000 as shown in at least FIGS. 8A-8B). Thus, the difference in depths may be about equal to a sum of thicknesses of the first roof section 220, the second roof section 320, the second wall panel 310, and a depth necessary to accommodate a connector.

Figure 5A:
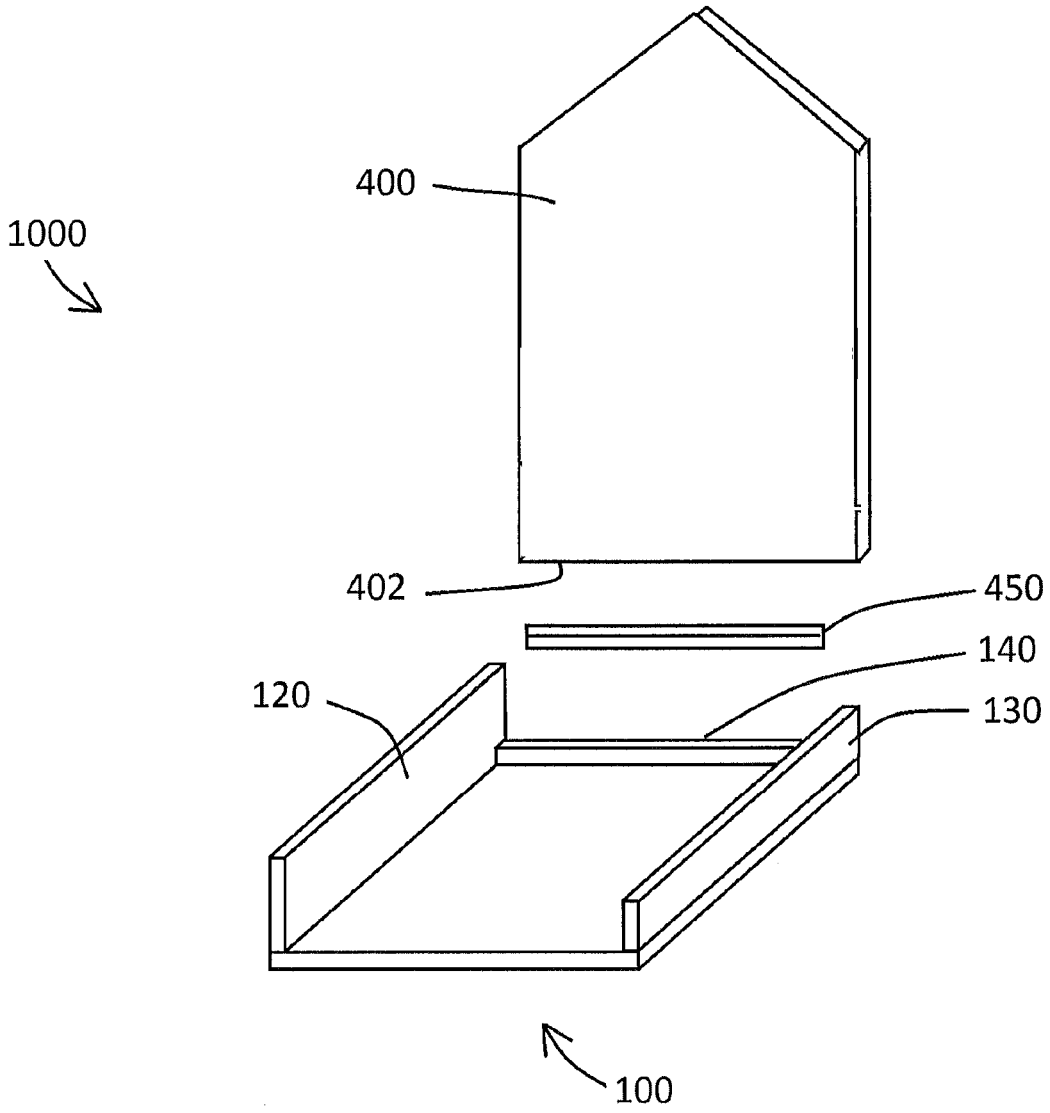
FIGS. 5A-5C are views of another wall and the base in accordance with example embodiments and various configurations of the wall and the base.
Figure 5B:
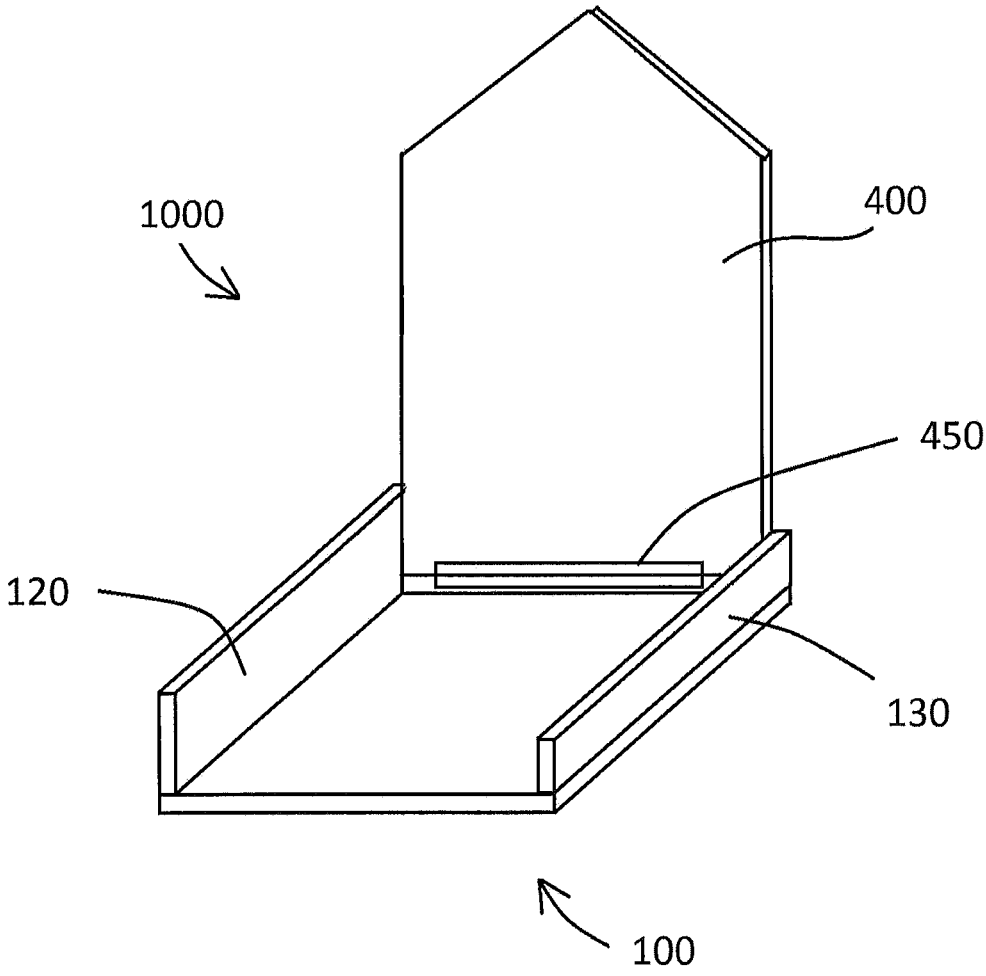

FIG. 5A illustrates an exploded view of the structure 1000 not including the, first, second, and fourth walls 200, 300, and 500. FIG. 5B illustrates the third wall 400 attached to the base 100. In example embodiments, the third wall 400 may be pivotally attached to the base 100. For example, as shown in FIGS. 5A and 5B, the third wall 400 may be pivotally attached to the base 100 via a third hinge 450. In example embodiments, the third hinge 450 may be, but is not limited to, a bi-fold hinge, a butt hinge, a case hinge, an offset hinge, and a continuous hinge. Example embodiments, however, are not limited to a single hinge 450 attaching the third wall 400 to the third subwall 140. For example, rather than using a single hinge 450, a plurality of hinges may connect the third wall 400 to the third subwall 140.

Figure 5C:
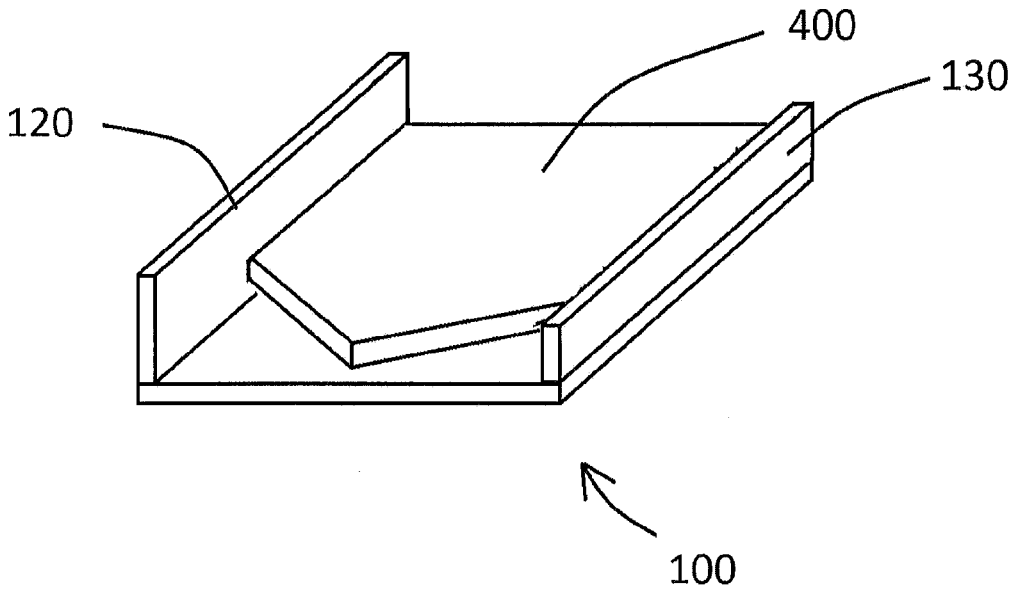

In example embodiments, the third wall 400 may be arranged over the third subwall 140 such that a bottom surface 402 of the third wall 400 faces an upper surface 142 of the third subwall 140. In this configuration, the third hinge 450 may pivotally connect the third wall 400 to the third subwall 140 as shown in FIG. 5B. Due to the nature of the pivotal connection, the third wall 400 may be rotated towards a middle of the base 100 as shown in FIG. 5C. In the alternative, the third wall 400 may be maintained in a substantially vertical orientation such that an upper surface thereof faces the first and second roof sections 220 and 320 when the first and second roof sections 220 and 320 are latched together as previously described.

In example embodiments, the depth d2 of the second subwall 130 may be larger than the depth d3 of the third subwall 140. For example, in example embodiments, the depth d2 of the second subwall 130 may be larger than the depth d3 of the third subwall 140 by an amount approximately equal to a sum of thicknesses of the second roof section 320 and the third wall 400. In example embodiments, the difference in depth may also take into account various connectors (3000 as shown in at least FIGS. 8A-8B). Thus, the difference in depths d2 and d3 may be about equal to a sum of thicknesses of the second roof section 320 and the third wall 400 and a depth necessary to accommodate a connector.

Figure 6A:
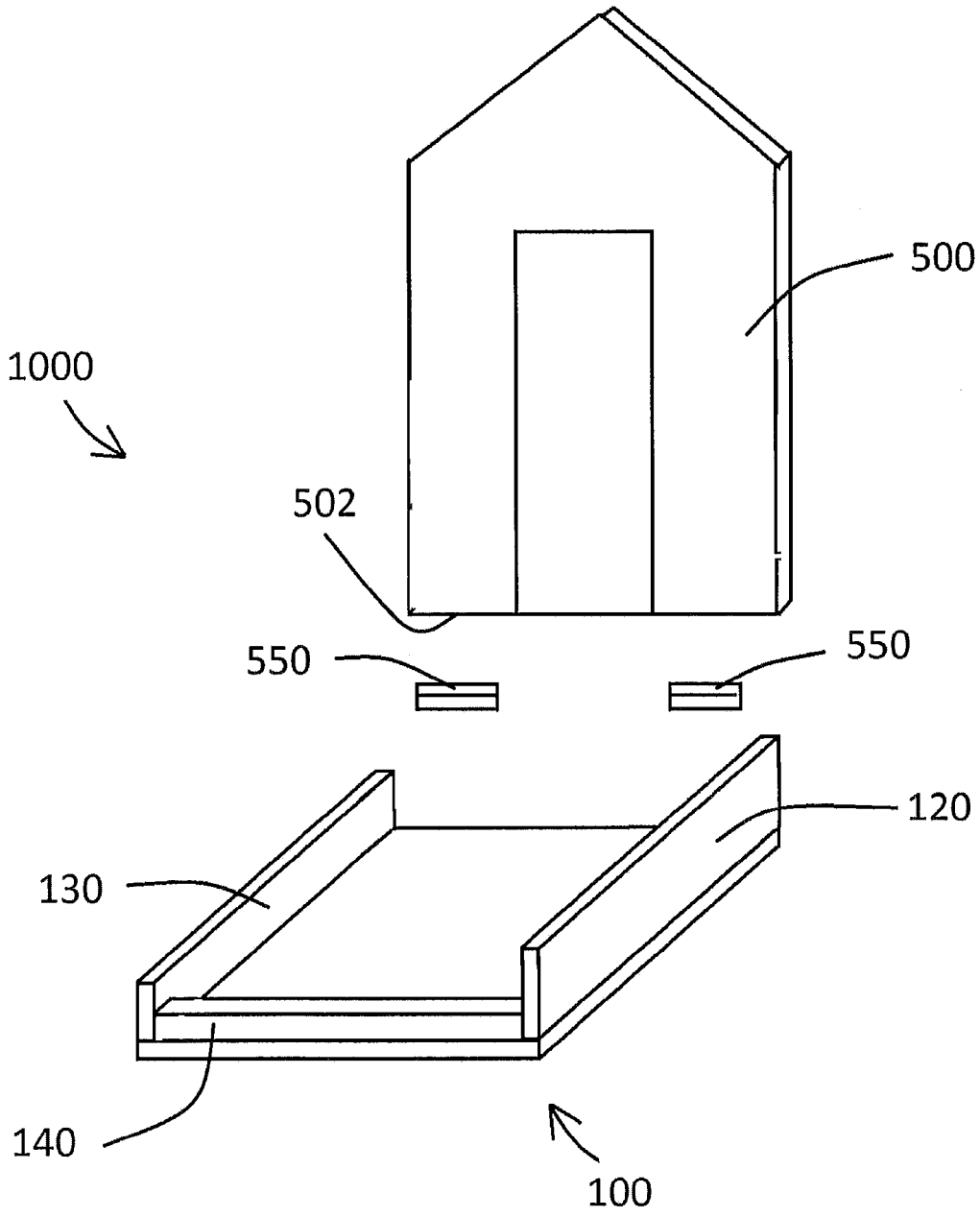
FIGS. 6A-6C are views of another wall and the base in accordance with example embodiments and various configurations of the wall and the base.
Figure 6B:
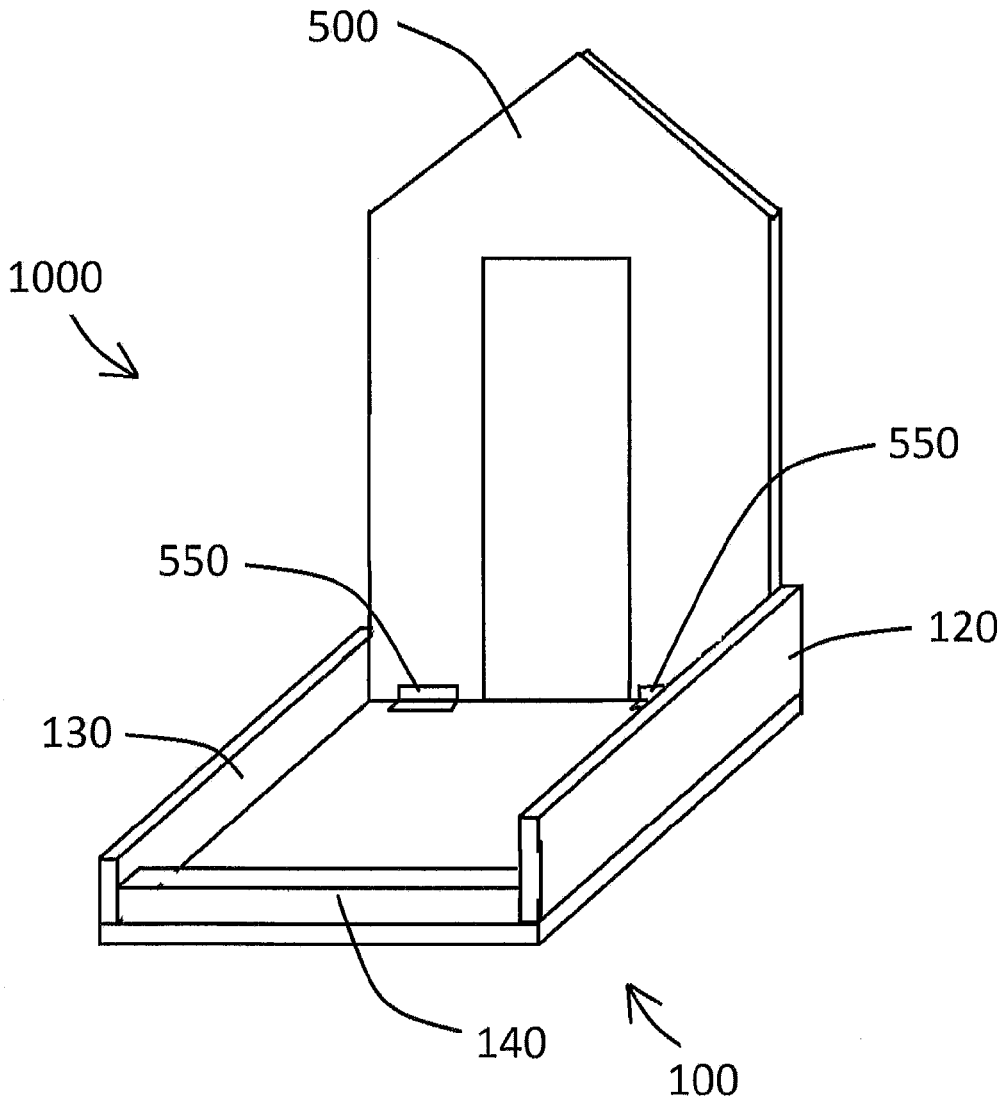

FIG. 6A illustrates an exploded view of the structure 1000 not including the, first, second, and third walls 200, 300, and 400. FIG. 6B illustrates the fourth wall 500 attached to the base 100. In example embodiments, the fourth wall 500 may be pivotally attached to the base 100 either directly or indirectly. For example, as shown in FIGS. 6A and 6B, the fourth wall 500 may be pivotally attached to the base 100 via a pair of hinges 550. For example, the fourth wall 500 may be directly attached to the floor 110 of the base 100 by the pair of hinges 550. On the other hand, though not shown in the figures, the fourth wall 500 may be pivotally attached to another subwall of the base and thus may not be directly attached to the floor 110 of the base 100. In example embodiments, the pair of hinges 550 may be, but is not limited to, a pair of bi-fold hinges, a pair of butt hinges, a pair of case hinges, and a pair of offset hinges. Example embodiments, however, are not limited to a pair of hinges 550 connecting the fourth wall 500 to the base 100. For example, more than two hinges may connect the fourth wall 500 to the floor or only a single hinge, rather than a pair of hinges, may connect the fourth wall 500 to the base 100.

Figure 6C:
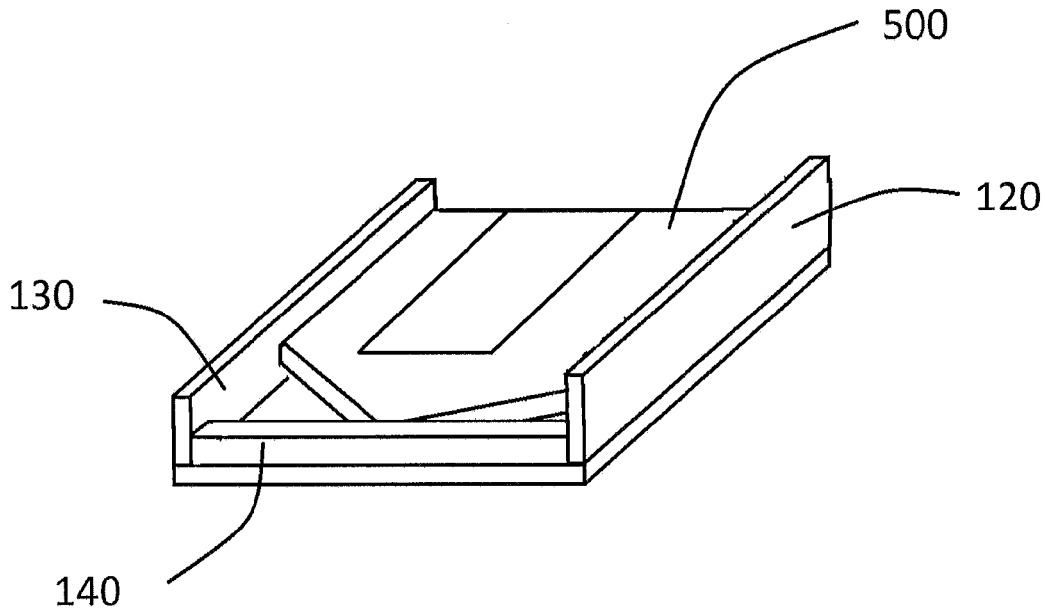

In example embodiments, the fourth wall 500 may be arranged over the floor 110 such that a bottom surface 502 of the fourth wall 500 faces an upper surface of the floor 110. In this configuration, the pair of hinges 550 may pivotally connect the fourth wall 500 to the floor 110 as shown in FIG. 6B. Due to the nature of the pivotal connection, the fourth wall 500 may be rotated towards a middle of the base 100 as shown in FIG. 6C. In the alternative, the fourth wall 500 may be maintained in a substantially vertical orientation such that an upper surface thereof faces the first and second roof sections 220 and 320 when the first and second roof sections 220 and 320 are connected together as previously described.

In example embodiments, the fourth wall 500 may be directly connected to the floor 110 and may be rotated onto the floor 110 such that the fourth wall 500 bears on the floor 110. In this nonlimiting example, the third wall 400 may be rotated so that the third wall 400 lies substantially flat on the fourth wall 500. In example embodiments, this may be accomplished by sizing the depth d3 of the third subwall 140 to be substantially the same as a thickness of the fourth wall 500. Example embodiments, however, are not limited thereto as the depth d3 may be sized to accommodate fasteners that may be used to connect various walls together. Thus, the depth d3 of the third subwall may be about the same as the thickness of the fourth wall 500 plus a depth associated with a connector.

Figure 7A:
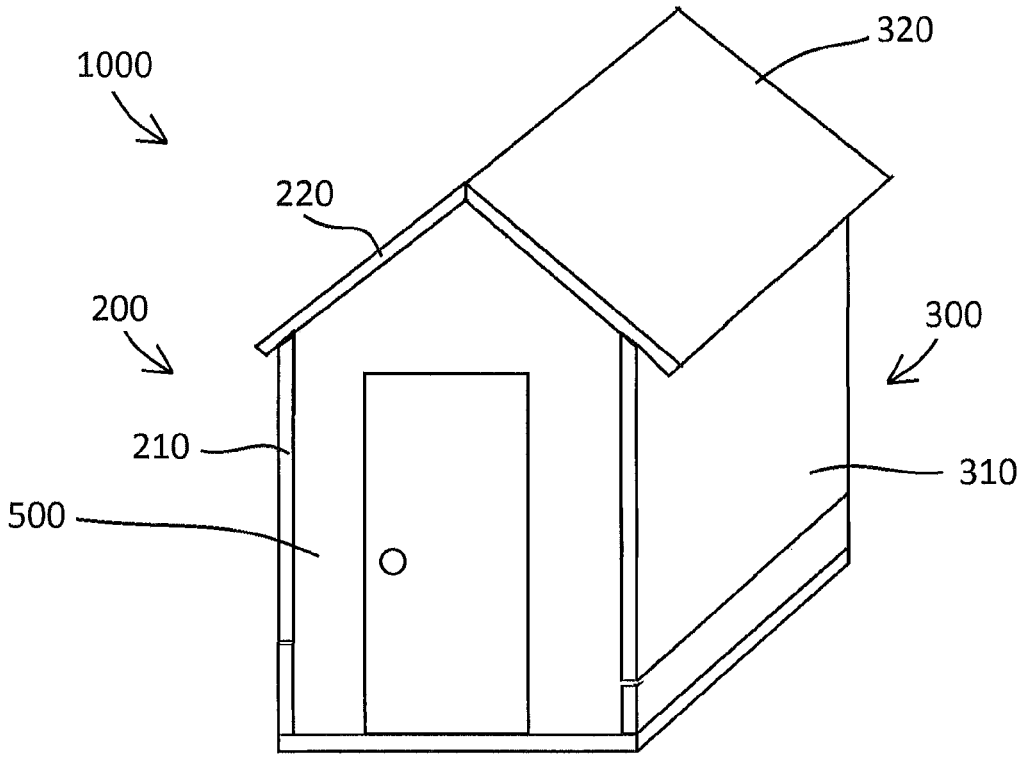
FIGS. 7A-7E are views illustrating the structure in accordance with example embodiments being collapsed into a compact structure.
Figure 7B:
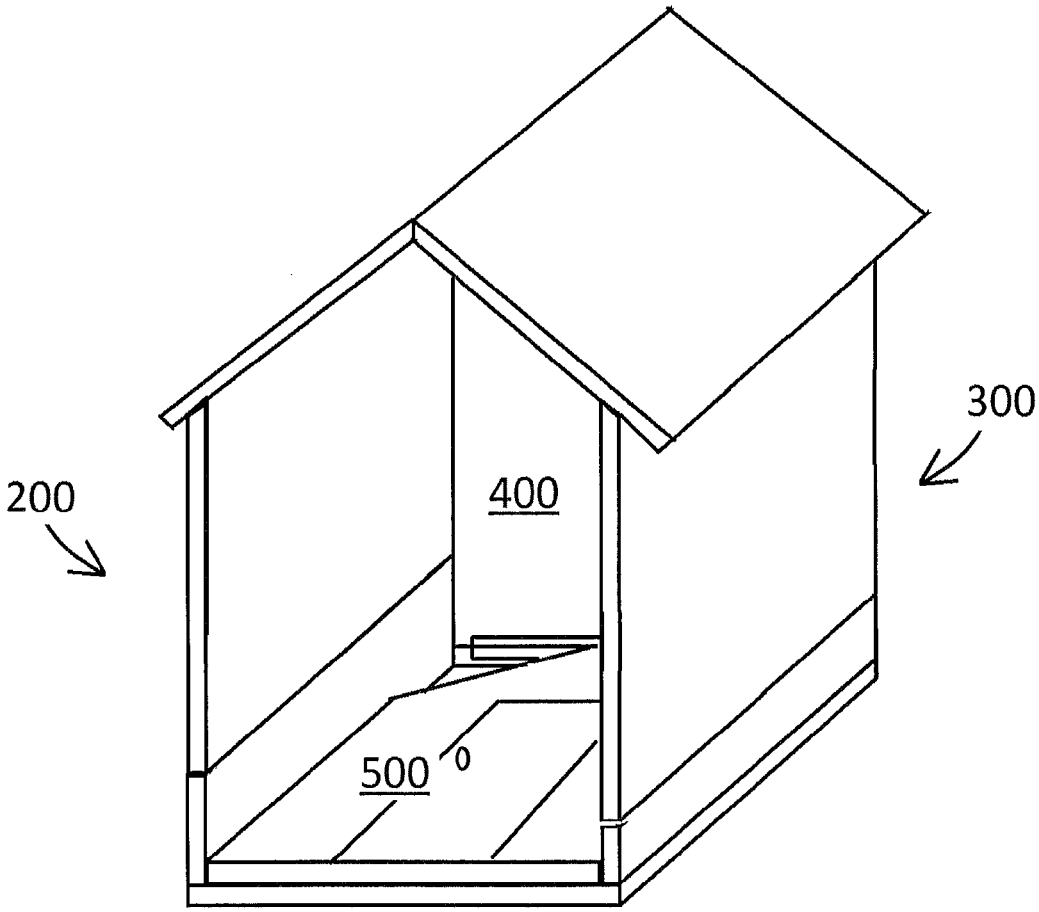
Figure 7C:
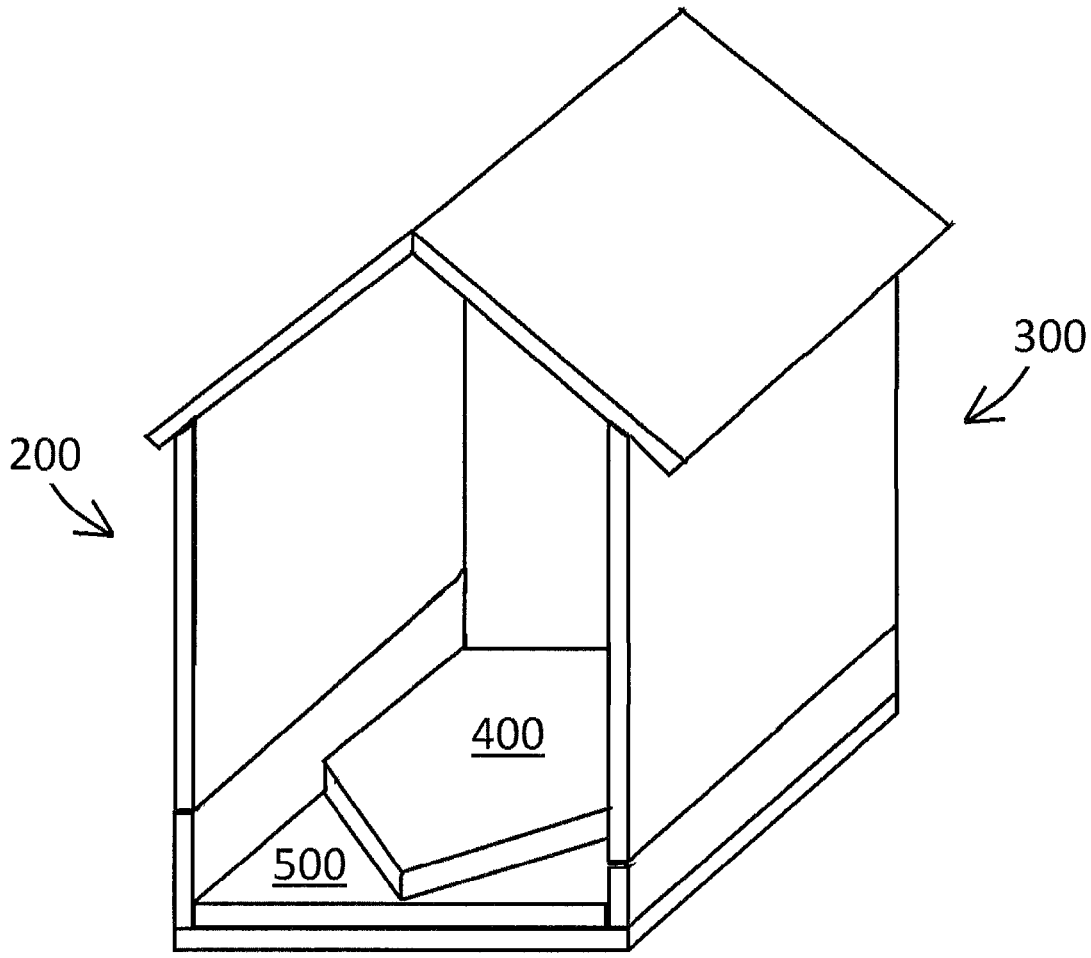
Figure 7D:
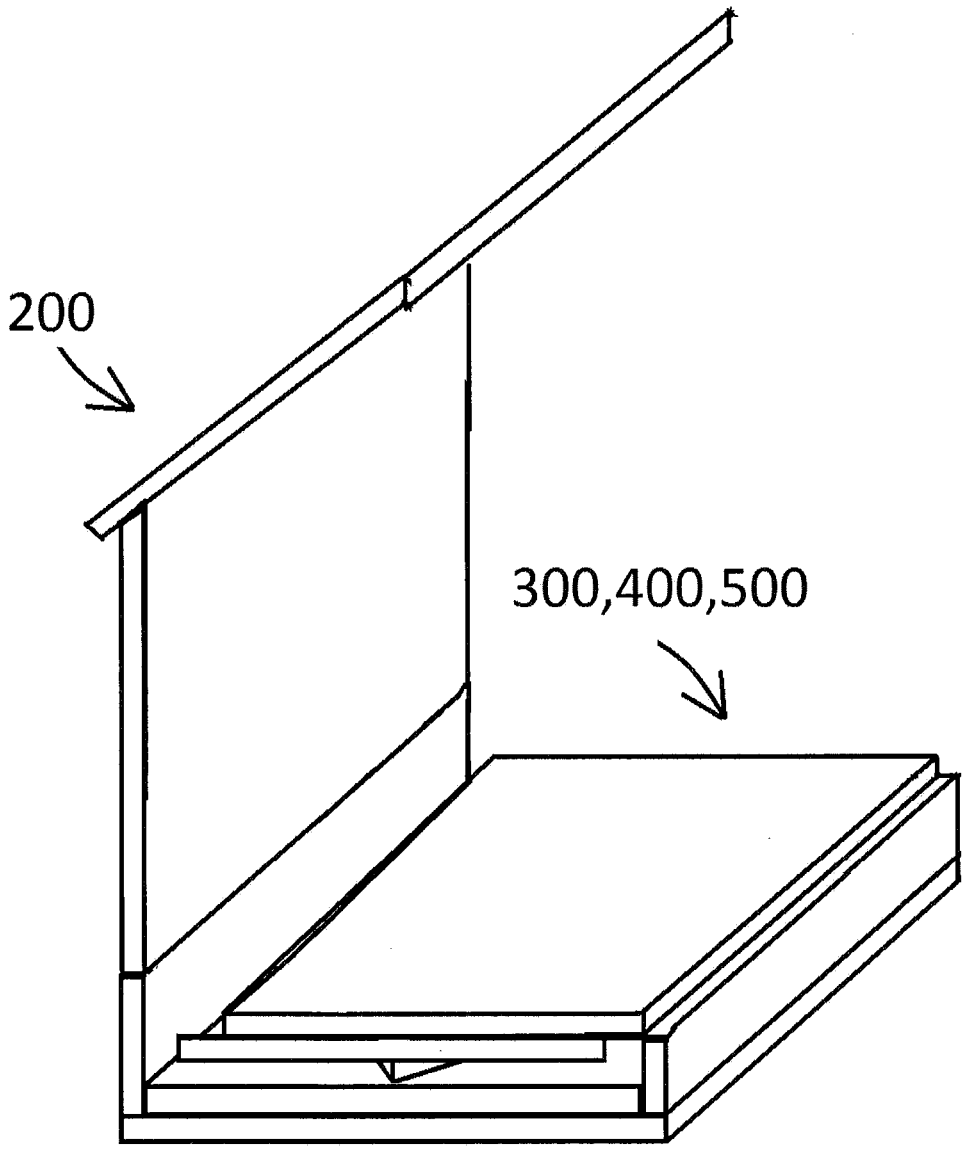
Figure 7E:
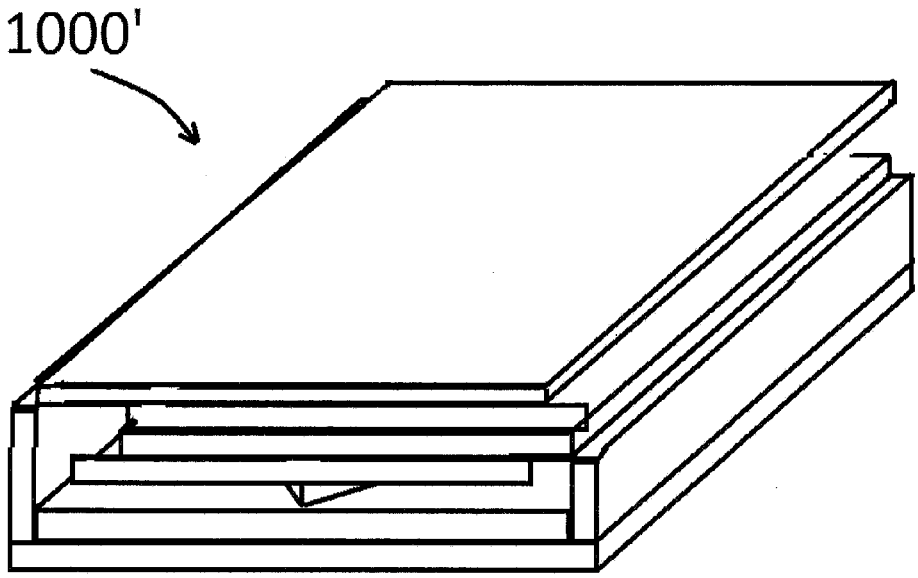

FIGS. 7A-7E illustrate various operations associated with folding the structure 1000 so as to form a relatively compact structure 1000'. As shown in FIG. 7A, the structure 1000 may be assembled so that the first, second, third, and fourth walls 200, 300, 400 and 500 are substantially vertical. Because the fourth wall 500 may be pivotally connected to the floor 110, however, the fourth wall 500 may be rotated towards the floor 110 until it rests on the floor 110 as shown in FIG. 7B. Once the fourth wall 500 is resting on the floor 110, the third wall 400 may be rotated towards the fourth wall 500 until it rests on top of the fourth wall 500 as shown in FIG. 7C. In this configuration, the second wall 300 may have the second roof section 320 folded against the second wall panel 310 and the wall second wall 300 may then be rotated until the folded second wall 300 lies on top of the third wall 400 as show in FIG. 7D. In this configuration, the first wall 200 may have the first roof section 220 folded against the first wall panel 210 and the first wall 200 may then be rotated until the folded first wall 200 lies on top of the second wall 300 as show in FIG. 7E to produce a relatively compact structure 1000'. The structure 1000 may be formed by simply reversing the above operations.

Figure 8A:
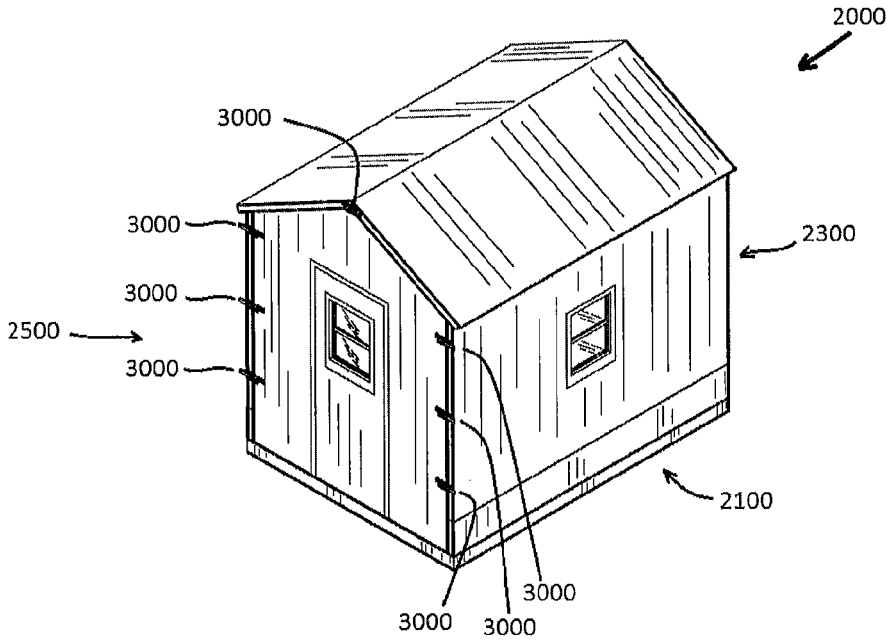
FIGS. 8A-8B are views of a structure in accordance with example embodiments.
Figure 8B:
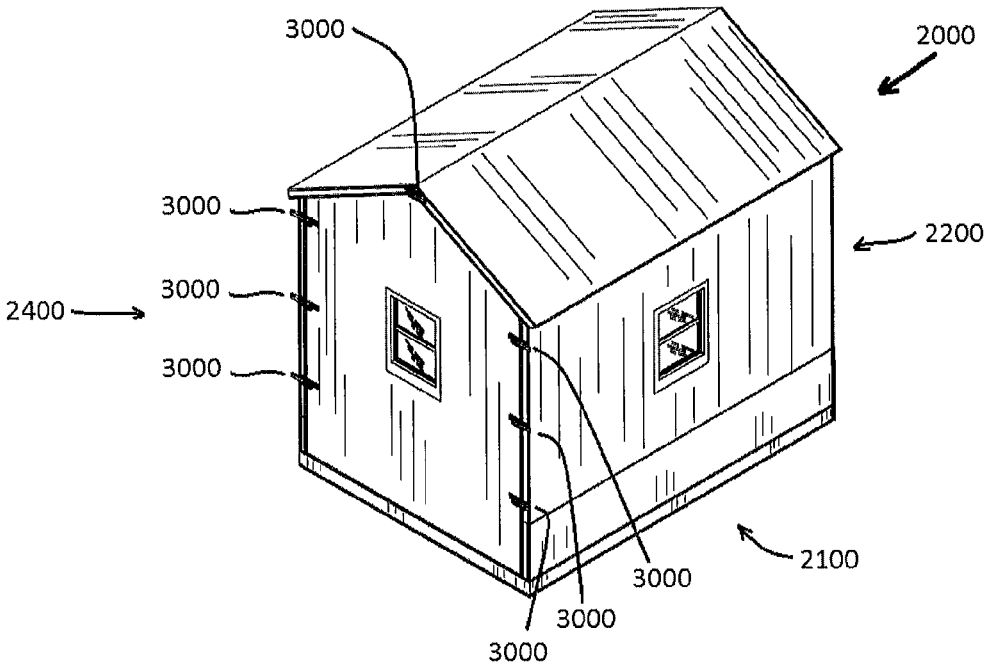

FIGS. 8A and 8B are views of another collapsible structure 2000 in accordance with example embodiments. As shown in FIGS. 8A and 8B, the collapsible structure 2000 may be substantially identical to the collapsible structure 1000. For example, in example embodiments, the collapsible structure 2000 may include a base 2100, a first wall 2200, a second wall 2300, a third wall, 2400, and a fourth wall 2500 which may be substantially the same as the base 100, the first wall 200, the second wall 300, the third wall 400, and the fourth wall 500. FIGS. 8A and 8B, however, illustrate connectors 3000 that may be used to connect the various walls together. For example, as shown in FIG. 8A, three connectors 3000 may be used to secure the fourth wall 2500 to the first wall 2200 and three connectors 3000 may be used to secure the fourth wall 2500 to the second wall 2300. Similarly, as shown in FIG. 8B, three connectors 3000 may be used to secure the third wall 2400 to the first wall 2200 and three connectors 3000 may be used to secure the third wall 2400 to the second wall 2300. Although the figures illustrate the use of three connectors 3000 to connect the various walls together, example embodiments are not limited thereto. For example, less than three connectors 3000 or more than three connectors 3000 may be used to connect the fourth wall 2500 to the first wall 2200.

Figure 9:
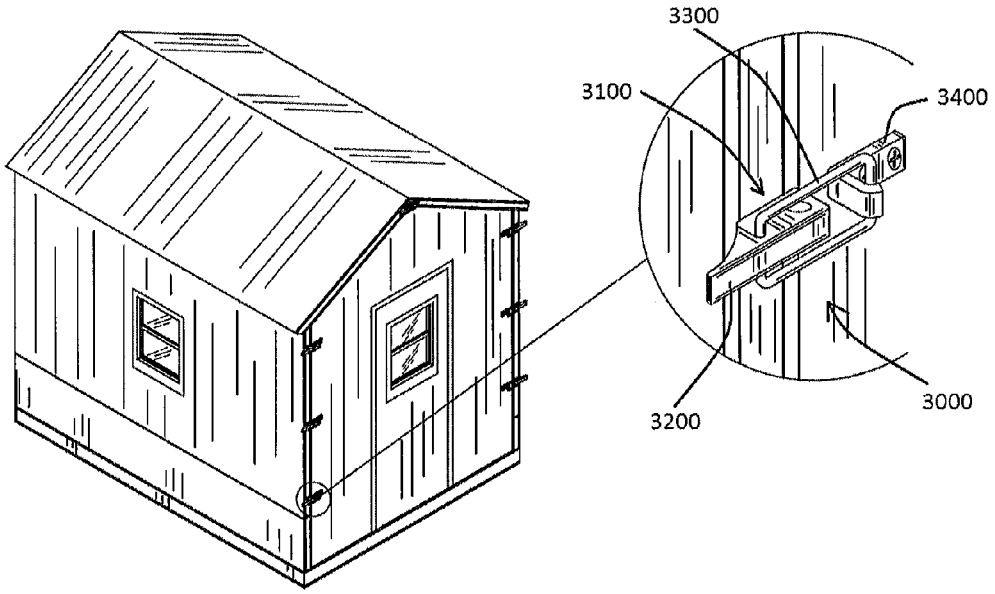
FIG. 9 is a view of a connector in accordance with example embodiments.
Figure 10A:
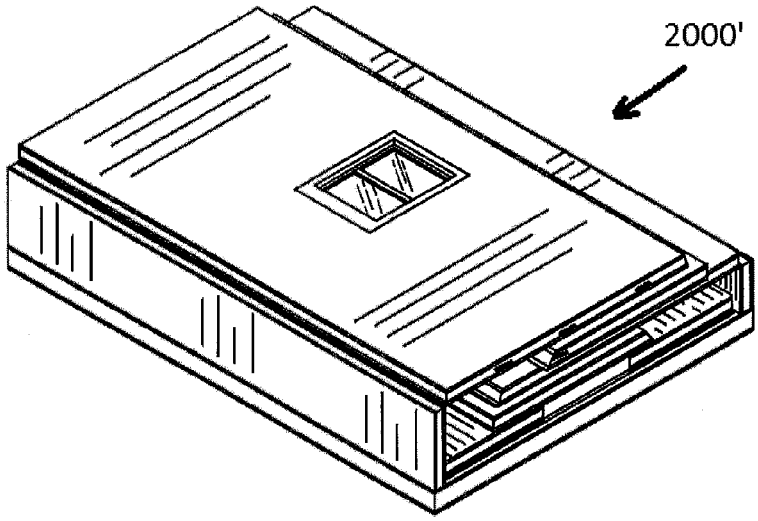
FIGS. 10A-10E are views of a structure being unfolded from a first relatively compact configuration to a second relatively open configuration.
Figure 10B:
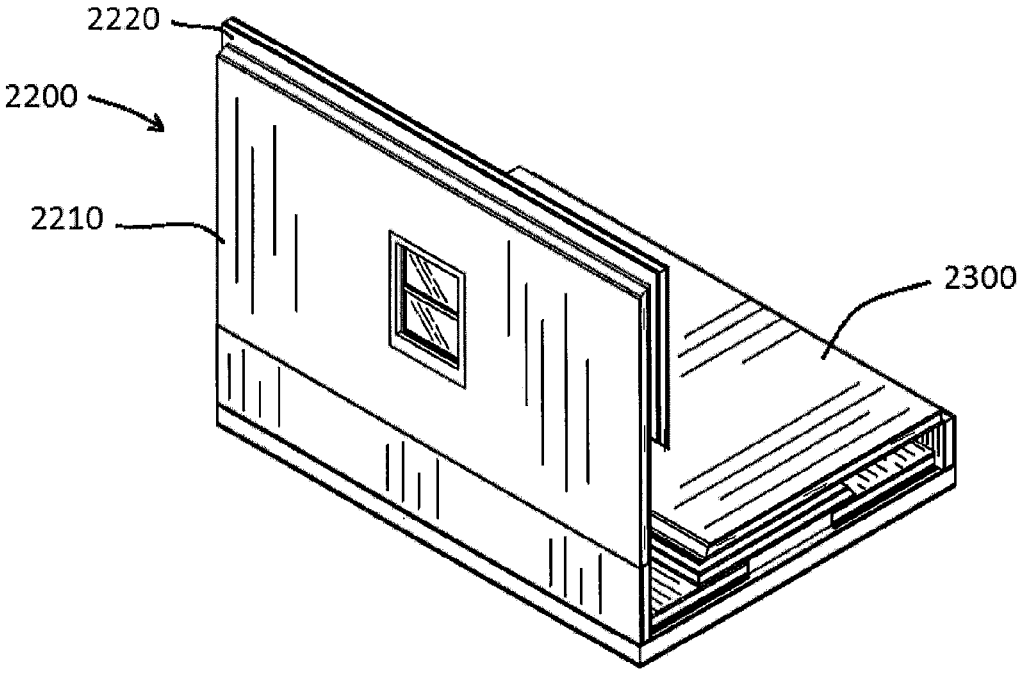
Figure 10C:
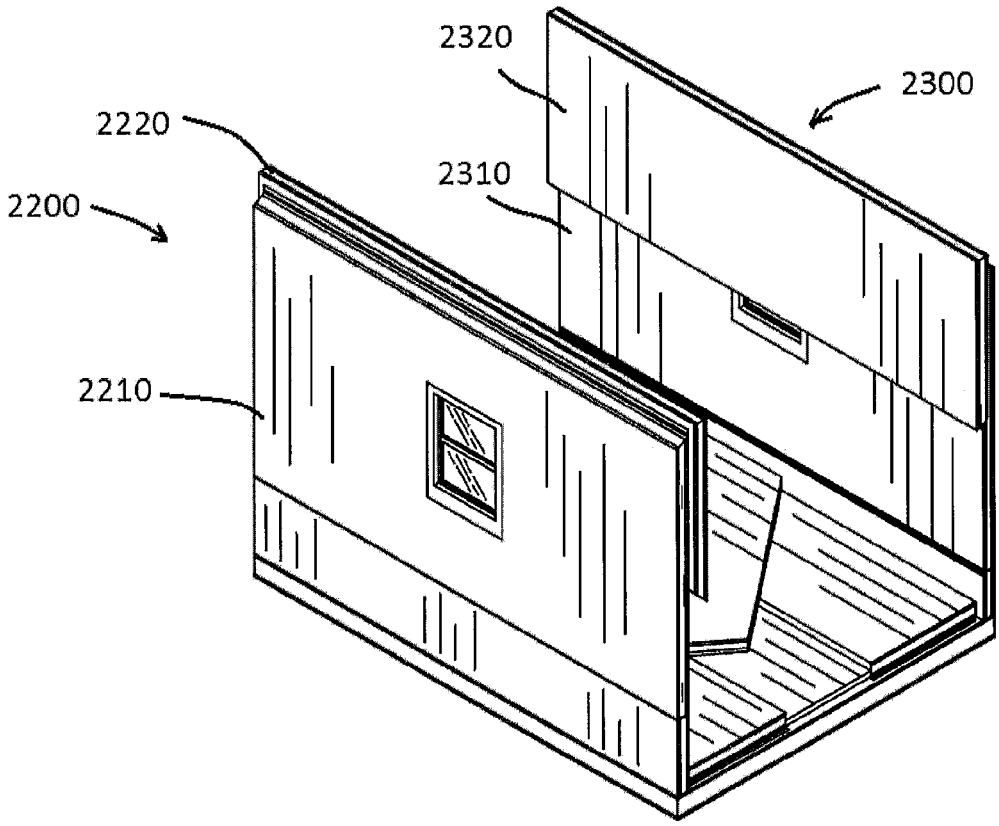
Figure 10D:
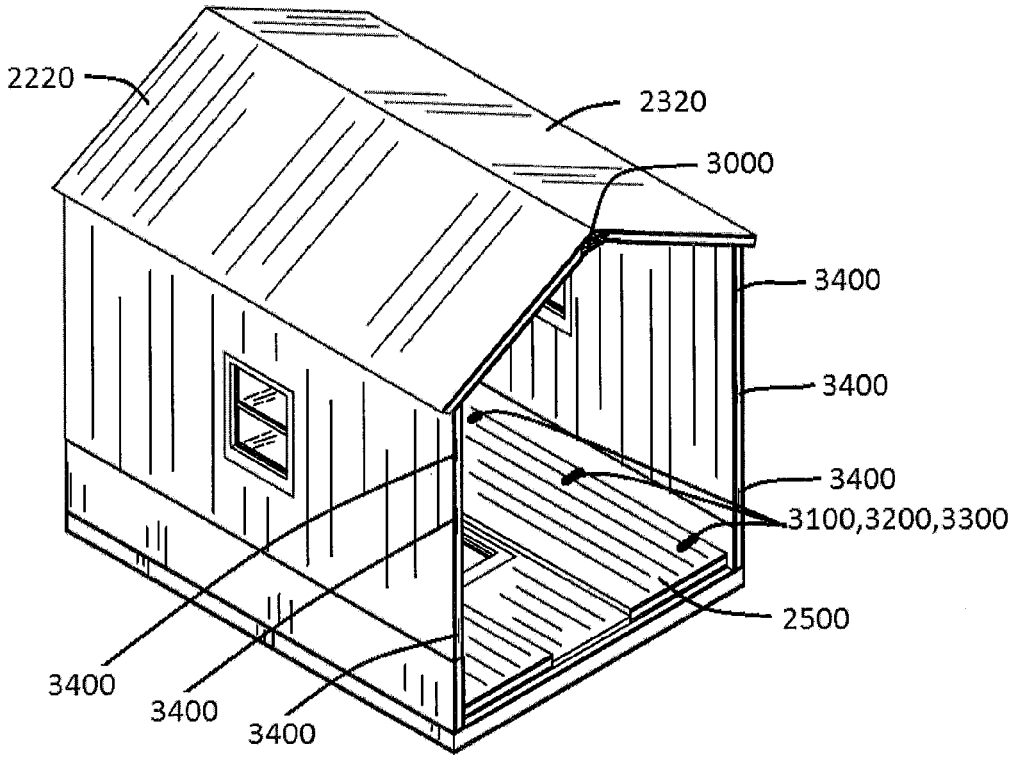
Figure 10E:
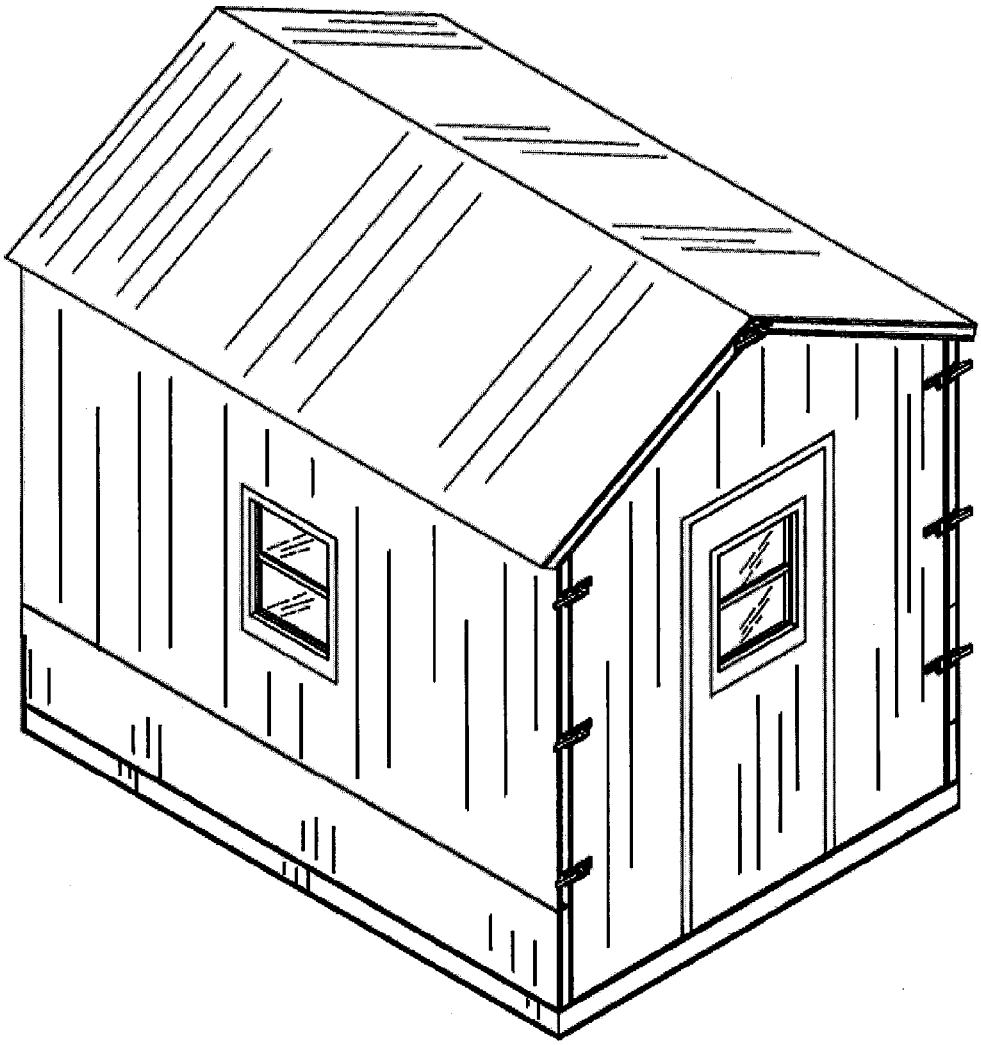

FIG. 9 is a close-up view of a connector 3000 in accordance with example embodiments. In example embodiments, the connector 3000 may resemble a conventional draw latch that includes a base 3100 having a handle 3200 and a catch 3300 and a keeper 3400. As is well known in the art, the base 3100 with the handle 3200 and catch 3300 may be attached to a first structure and the keeper 3400 may be attached to a second structure so that the first structure and the second structure may be connected to one another via the draw latch. It is understood that the connector 3000 of example embodiments is not limited to a draw latch having the base 3100, the handle 3200, the catch 3300 and the keeper 3400. For example, the connector 3000 may be another type of latch such as, but not limited to, a cam latch, a hook latch, a flexible latch, and/or a draw latch. Furthermore, the connector 3000 is not required to be a latch. For example, the connector 3000 may alternatively represent a pin-type connector or a screws and plates as is well known in the art.

FIG. 10 illustrates the structure 2000 in a collapsed condition 200'. Consistent with the earlier described structure 1000, the collapsed structure 2000' may be unfolded to yield the structure 2000 illustrated in at least FIGS. 8A-8B. For example, as shown in FIG. 10B the first wall 2200 may be rotated so that a wall panel 2120 of the first wall 2200 is substantially vertical. Then, as shown in FIG. 10C, the second wall 2300 may be rotated so that a second wall panel 2310 of the second wall 2300 is vertical. In example embodiments, a first roof section 2220 of the first wall 2200 and a roof section 2320 of the second wall 2300 may be rotated towards each other as shown in FIG. 10D until edges of the first and second roof sections 2220 and 2320 are substantially flush against one another. In this configuration, the connector 3000, for example, a latch, may be used to secure the first roof section 2220 to the second roof section 2320 to form a roof of the second structure 2000. For example, in example embodiments, the base 3100, the handle 3200, and the catch 3300 may be arranged on the first roof section 2220 and the keeper 3400 may be arranged on the second roof section 2320 so that when edges of the first and second roof sections 2220 and 2320 are substantially flush against one another, the catch 3300 may interface with the keeper 3400 to secure the first roof section 2220 to the second roof section 2320. In example embodiments, the third and fourth walls 2400 and 2500 may then be rotated to be substantially vertical. In this configuration, the various connectors 3000 illustrated in FIGS. 8A-8B may be engaged to secure the first and second walls 2200 and 2300 to the third and fourth walls 2400 and 2500 as shown in FIG. 10E. For example, in example embodiments the catches 3400 of the connectors 3000 may be arranged on the first and second walls 2200 and 2300 and the base 3100, the handle 3200, and the catch 3300 of the connectors 3000 may be on the third and fourth walls 2400 and 2500.

Though not described with particularity, the walls of the previously described structures 1000 and 2000 may include features to enhance its usability. For example, as shown in the figures, the fourth walls 500 and 2500 may include a door allowing a user access to an inside of the structures 1000 and 2000. Similarly, the walls 200, 300, 400, 2200, 2300, 2400 may or may not include windows. Further, the materials used to manufacture the structures may vary according to its intended purpose. For example, the walls base 100 and 2100 and the walls 200, 300, 400, 500, 2200, 2300, 2400, and 2500 may be made from plastic, wood, or a composite material. For example, the walls 200, 300, 400, 500, 2200, 2300, 2400, and 2500 may be made from a sandwich type structure where a layer of foam is sandwiched between two wood or plastic layers. Thus, the structures 1000 and 2000 may be relatively light weight, strong, and insulated structures. Further, although the connectors 3000 are not required to be latches, the use of latches increases the ease at which the structures 1000 and 2000 may be folded and unfolded.

Figure 11A:
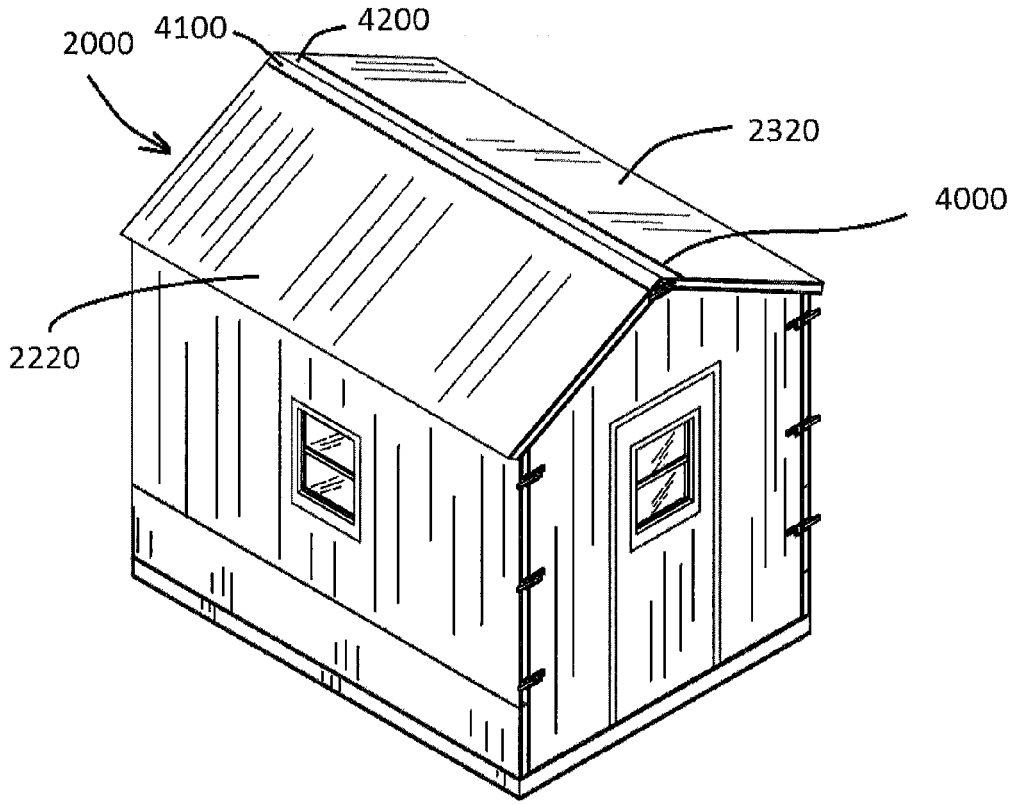
FIGS. 11A-11C are views of a collapsible structure including a ridge cap.

FIG. 11A illustrates the collapsible structure 2000 further including a ridge cap 4000. In example embodiments, the ridge cap 4000 may include a first section 4100 on the first roof section 2220 and a second section 4200 on the second roof section 2320. Although the figures illustrate the first and second sections 4100 and 4200 spanning the lengths of the first and second roof sections 2220 and 2320, the invention is not limited thereto since the first and second sections 4100 and 4200 are not required to span the lengths of the first and second roof sections 2220 and 2320 and may, in fact, only span a portion thereof.

In example embodiments, the ridge cap 4000 may be a substantially integral structure. For example, the ridge cap 4000 may be formed from a rectangular piece of sheet metal which is bent in the middle to form the first and second sections 4100 and 4200. On the other hand, the ridge cap 4000 may be formed from a casting process having cast designed to form the first and second sections 4100 and 4200 when a mold material is poured therein. In the alternative, the ridge cap 4000 may be formed by welding together two rectangular pieces of sheet metal. Thus, there are a variety of ways to fabricate the ridge cap 4000 and the preferred method may depend on the type of material chosen for the ridge cap 4000. In example embodiments, the ridge cap 4000 may be formed from a metal, a rubber, a plastic, a composite material, and/or a combination thereof.

Figure 11B:
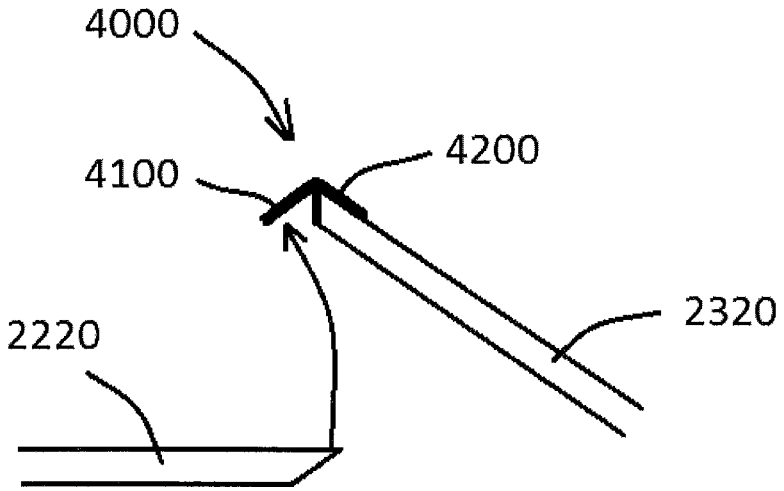
Figure 11C:
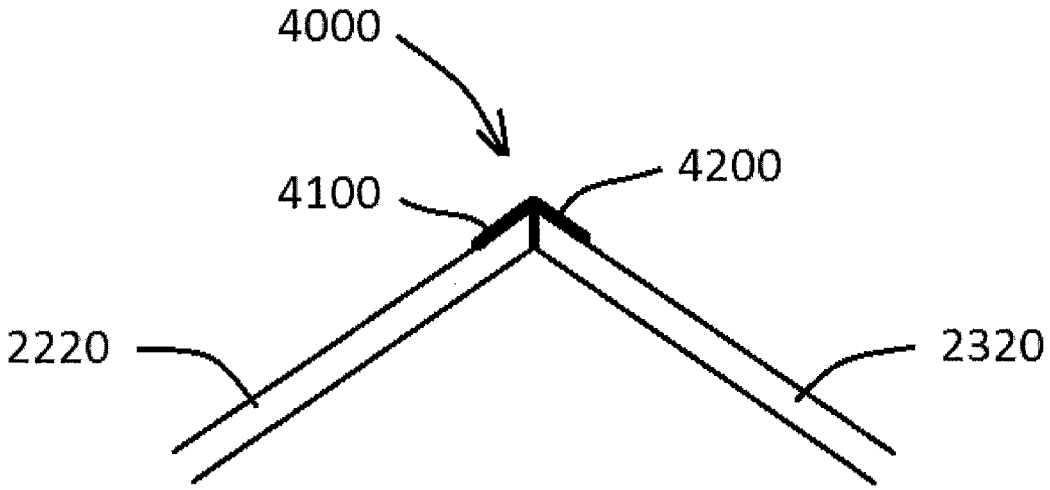

In example embodiments one of the first and second sections 4100 and 4200 may be attached to one of the first and second roof sections 2220 and 2320. For example, FIG. 11B illustrates an operation wherein the first roof section 2220 is rotated towards the second roof section 2320. In this example, the second section 4200 of the ridge cap 4000 is attached to the second roof section 2320 by a conventional means such as, but not limited to, welding, gluing, and/or bolting. In this particular nonlimiting example, the first roof section 2220 may be rotated to connect to the second roof section 2320 as shown in FIG. 11C and then secured to the second roof section 2320 by means of a latch as previously described (noting a latch is not illustrated in FIGS. 11B and 11C). In this nonlimiting example embodiment, the first section 4100 may be configured so that it covers a portion of the first roof section 2220 or actually applies a pressure to the first roof section 2220 when the first and second roof sections 2220 and 2320 are secured together. Pressure may be applied, for example, by forming the ridge cap 4000 from a resilient material, such as, but not limited to, metal, plastic, rubber, and/or a composite material, so that the first portion 4100 flexes when it comes into contact with the first roof section 2220.

In example embodiments, the ridge cap 4000 may provide several benefits. As a first benefit, the ridge cap 4000 may offer occupants of the collapsible structure 2000 further protection from the elements by sealing or covering a potential gap that may form between the first and second roof sections 2220 and 2320. As another example, in the event the collapsible structure 2000 encloses a heating source, the ridge cap 4000 may prevent or reduce heat from flowing out of the collapsible structure 2000.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What I claim is:

1. A structure configured to collapse from a first configuration to a second configuration, the structure being comprised of:

a base having a first subwall, a second subwall, and a third subwall, the first subwall having a first depth, the second subwall having a second depth, and the third subwall having a third depth;

a first wall pivotally connected to the first subwall;

a second wall pivotally connected to the second subwall;

a third wall pivotally connected to the third subwall; and a fourth wall pivotally connected to the base, wherein the first depth is greater than the second depth and the second depth is greater than the third depth, wherein a distance from a top surface of the base to a top surface of the first subwall is greater than a distance from the top surface of the base to a top surface of the second subwall which is greater than a distance from the top surface of the base to a top surface the third subwall which is greater than 0.

2. The structure of claim 1, wherein the third and fourth walls are configured to rotate between the first and second walls.

3. The structure of claim 2, wherein the fourth wall is configured to rotate to a position which is substantially parallel to a floor of the base.

4. The structure of claim 3, wherein the third wall is configured to rotate onto the fourth wall and be substantially parallel with the floor and the fourth wall when the fourth wall is rotated in a position that is substantially parallel with the floor.

5. The structure of claim 1, wherein the fourth wall is directly connected to a floor of the base.

6. The structure of claim 1, wherein in the first configuration, wall panels of the first, and second walls are substantially perpendicular to a floor of the base and in the second position the wall panels of the first and second walls are substantially parallel to the floor of the base.

7. The structure of claim 1, wherein the first wall includes a first roof section pivotally attached a first wall panel and the second wall includes a second roof section pivotally attached to a second wall panel.

8. The structure of claim 7, wherein the first depth is equal to or greater than a sum of a thickness of the fourth wall, a thickness of the third wall, a thickness of the second wall panel, a thickness of the second roof section, and a thickness of the first roof section.

9. The structure of claim 7, wherein the first roof section includes a first connecting structure and the second roof section includes a second connecting structure configured to engage the first connecting structure to secure the first roof section to the second roof section.

10. The structure of claim 9, wherein the first connecting structure is one of a keeper and a catch and the second connecting structure is the other of the keeper and the catch.

11. The structure of claim 9, wherein the keeper and the catch are part of a same latch connector.

12. The structure of claim 1, wherein the first wall includes a plurality of first connecting structures and the fourth wall includes a second plurality of connecting structures configured to engage the plurality of first connecting structures.

13. The structure of claim 12, wherein at least one of the first connecting structures includes one of a keeper and a catch and at least one of the second connecting structures includes the other of the keeper and the catch and the catch is configured to engage the keeper.

14. The structure of claim 13, wherein the keeper and the catch are part of a same latch connector.

15. A structure configured to collapse from a first configuration to a second configuration, the structure being comprised of:

a base;

a first wall pivotally connected to the base, the first wall including a first wall panel and a first roof section;

a second wall pivotally connected to the base, the second wall including a second wall panel and a second roof section;

a third wall pivotally connected to the base;

a fourth wall pivotally connected to the base;

a first latch having a first keeper on one of the first and second roof sections and a first catch on the other of the first and second roof sections, the first catch being configured to engage the first keeper;

a first plurality of latches connecting the first wall to the fourth wall;

a second plurality of latches connecting the first wall to the third wall;

a third plurality of latches connecting the fourth wall to the second wall; and a fourth plurality of latches connecting the second wall to the third wall.

16. The structure of claim 15, wherein the base has a first subwall with a first depth, a second subwall with a second depth, and a third subwall with a third depth, the first wall is pivotally connected to the first subwall, the second wall is pivotally connected to the second subwall, and the third wall is pivotally connected to the third subwall.

17. The structure of claim 16, wherein:

the first depth is greater than the second depth and the second depth is greater than the third depth.

18. The structure of claim 15, wherein in the first position the first, second, third, and fourth walls are oriented substantially perpendicular to the base and in the second position the first, second, third, and fourth walls are substantially parallel to the base.

19. The structure of claim 16, wherein a distance from a top surface of the base to a top surface of the first subwall is greater than a distance from the top surface of the base to a top surface of the second subwall which is greater than a distance from the top surface of the base to a top surface the third subwall which is greater than 0.

20. The structure of claim 15, wherein in the first position the first, second, third, and fourth walls are oriented substantially perpendicular to the base and in the second position the first, second, third, and fourth walls are substantially parallel to the base and in the first position the first plurality of latches are arranged on outside surfaces of the first wall and the fourth wall, the second plurality of latches are arranged on outside surfaces of the first wall and the third wall, the third plurality of latches are on outside surfaces of the fourth wall and the second wall, the fourth plurality of latches is arranged on outside surfaces of the second wall and the third wall, and the first latch has the first keeper on an outside surface of one of the first and second roof sections and the first catch on an outside surface of the other of the first and second roof sections.

* * * * *